US007097530B2

(12) United States Patent
Katakura et al.

(10) Patent No.: US 7,097,530 B2
(45) Date of Patent: Aug. 29, 2006

(54) ELECTRON SOURCE SUBSTRATE AND DISPLAY APPARATUS USING IT

(75) Inventors: Kazunori Katakura, Kanagawa (JP); Takahiro Hachisu, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 244 days.

(21) Appl. No.: 10/234,148

(22) Filed: Sep. 5, 2002

(65) Prior Publication Data

US 2003/0062843 A1 Apr. 3, 2003

(30) Foreign Application Priority Data

Sep. 7, 2001 (JP) ..... 2001-271937
Aug. 21, 2002 (JP) ..... 2002-240615

(51) Int. Cl.
*H01J 1/30* (2006.01)

(52) U.S. Cl. ..... 445/50; 445/51; 313/491

(58) Field of Classification Search ..... 445/50, 445/51; 313/491, 495–497, 458, 463, 309, 313/391; 315/169.2–169.4
See application file for complete search history.

(56) References Cited

U.S. PATENT DOCUMENTS

| | | | | |
|---|---|---|---|---|
| 4,954,752 A | * | 9/1990 | Young et al. | 315/169.3 |
| 5,593,335 A | * | 1/1997 | Suzuki et al. | 445/50 |
| 5,659,329 A | | 8/1997 | Yamanobe et al. | 345/74 |
| 5,905,335 A | * | 5/1999 | Fushimi et al. | 313/495 |
| 6,137,218 A | | 10/2000 | Kaneko et al. | 313/495 |
| 6,296,896 B1 | | 10/2001 | Takahashi et al. | 427/77 |

FOREIGN PATENT DOCUMENTS

| | | |
|---|---|---|
| EP | 0 936 652 | 8/1999 |
| JP | 64-031332 | 2/1989 |
| JP | 2-247936 | 10/1990 |
| JP | 02-247936 | 10/1990 |
| JP | 2-247937 | 10/1990 |
| JP | 02-247937 | 10/1990 |
| JP | 6-295659 | 10/1994 |
| JP | 06-342636 | 12/1994 |
| JP | 07-32683 | 12/1995 |
| JP | 7-326287 | 12/1995 |
| JP | 07-326311 | 12/1995 |
| JP | 08-185818 | 7/1996 |
| JP | 09-050757 | 2/1997 |
| JP | 09-102271 | 4/1997 |
| JP | 2000-251665 | 9/2000 |
| WO | WO 00/22643 | 4/2000 |

* cited by examiner

*Primary Examiner*—Wilson Lee
(74) *Attorney, Agent, or Firm*—Fitzpatrick, Cella, Harper & Scinto

(57) ABSTRACT

There is provided an electron source substrate capable of, even with occurrence of discharge between an anode and an electron-emitting device, avoiding the negative effect on other electron-emitting devices. The electron source substrate has row-directional wiring laid in a row direction; column-directional wiring laid in a column direction so as to intersect with the row-directional wiring; and an electron-emitting device one end of which is coupled to the row-directional wiring, the other end of which is coupled through a resistor element to the column-directional wiring, and to which a predetermined drive voltage is supplied through the wiring, and is configured so that a wiring resistance of the column-directional wiring is higher than a wiring resistance of the row-directional wiring.

7 Claims, 18 Drawing Sheets

ELECTRON SOURCE SUBSTRATE AND DISPLAY APPARATUS USING IT

BACKGROUND OF THE INVENTION

1. Field of the Invention

The present invention relates to an electron source substrate in which a plurality of electron-emitting devices are arranged in a matrix pattern, and display apparatus using it.

2. Related Background Art

As the electron-emitting devices used in the display apparatus of this type, there are two types of devices: thermal electron sources and cold cathode electron sources. The cold cathode electron sources include field emission devices, metal/insulator/metal devices, surface conduction electron-emitting devices (hereinafter referred to as SCE devices), and so on. The SCE devices will be described herein.

The SCE devices are devices making use of the phenomenon in which electrons are emitted when an electric current is allowed to flow through a thin film of a small area formed on a substrate and in parallel to the film surface. FIGS. 19A and 19B show the configuration of the M. Hartwell's device as a typical device configuration of the SCE devices. FIG. 19A is a top plan view of the device and FIG. 19B a side view thereof.

With reference to FIGS. 19A and 19B, this SCE device is constructed in structure in which a pair of device electrodes 142, 143 having the device electrode spacing L and the device electrode length W are formed on a substrate 141 of glass or the like, an electroconductive thin film 144 is formed so as to connect these device electrodes 142, 143, and an electron-emitting region 145 is formed near the center of the electroconductive thin film 144.

Since the SCE devices are simple in structure and easy in production, they are advantageous in permitting a lot of devices to be arrayed over a large area. Therefore, they are readily applicable to the display apparatus and a variety of display apparatus have been proposed heretofore.

The following will briefly describe the structure and operation of an ordinary display apparatus provided with an electron source substrate in which the SCE devices are arranged in a matrix.

FIG. 20 is a perspective view showing a portion of a conventional display panel extracted. This display panel is provided with a face plate 159 having a phosphor 150 on a lower surface and a rear plate 151 opposed thereto. In the rear plate 151, a plurality of electron-emitting devices 156 to 158 are formed each in a configuration consisting of a pair of device electrodes 152, 153 and an electroconductive thin film 154 formed so as to connect them and having an electron-emitting region 155 near the center. These electron-emitting devices 156 to 158 are similar to the SCE devices shown in FIGS. 19A and 19B.

In this display panel, when a device voltage Vf of ten and several Volts is placed between the device electrodes 152, 153, electrons are emitted from the lower potential side of each electron-emitting region 155 and part of electrons impinge upon the face plate 159 serving as an anode to which a voltage of several kV is applied, thereby inducing emission of light from the phosphor 150.

For reference, the following provides some of related technologies developed by Assignee, as technologies about the above-stated SCE devices.

Japanese Patent Applications Laid-Open No. 09-102271 and No. 2000-251665 detail production of the SCE devices by the ink jet forming method. Japanese Patent Applications Laid-Open No. 64-031332 and No. 07-326311 detail examples of the matrix arrangement of the SCE devices. Furthermore, Japanese Patent Applications Laid-Open No. 08-185818 and No. 09-050757 describe wiring forming methods of the electron source substrate provided with the SCE devices, and Japanese Patent Application Laid-Open No. 06-342636 and others detail driving methods. Japanese Patent Applications Laid-Open No. 02-247936, No. 02-247937, and No. 07-326283 disclose placement of a resistor element in series to the SCE device in order to enhance uniformity of characteristics of the electron-emitting device.

The display apparatus using the conventional SCE devices described above had the problems as described below, however.

When the conventional display panel shown in FIG. 20 was driven, for example, by applying the device voltage Vf of ten and several Volts between the device electrodes 152, 153 of the electron-emitting device 158 to cause emission of electrons therefrom and accelerating the emitted electrons by the acceleration voltage of several kV, there sometimes occurred a short circuit between the lower potential side and the higher potential side of the electron-emitting device because of adsorbates near the electron-emitting region 155, or discharge due to local degassing, or the like. On that occasion, an over current sometimes flowed through the electron-emitting device 158 to break the electroconductive thin film 154 and the electrodes 152, 153. Furthermore, the gas evolved on that occasion induced discharge between the anode and the electron-emitting region 155 to break the electroconductive thin film 154 and the electrodes 152, 153 and an abnormal voltage was also applied through wiring to the other electron-emitting devices 156, 157 electrically coupled, thereby causing deterioration of these devices. Conventionally, such phenomena posed the problem that nonuniformity of luminance or the like resulted in degradation of quality of displayed images.

If the voltage applied to the anode is increased, discharge will occur between the electron-emitting region of the electron-emitting device and the anode. The number of devices damaged by this discharge tends to increase with increase in the anode voltage. The reason for it is as follows: an abnormal current flowing upon the discharge becomes larger, so as to increase the degree of the damage to the device and increase the abnormal voltage applied to the wiring, thereby increasing the number of devices affected through the wiring. For this reason, it was impossible to adequately increase the anode voltage heretofore, and this was a cause of decrease in the luminance of the display panel.

The problems as described above did not allow the surface conduction electron-emitting devices to be positively applied in industries though they had the advantage of simple device structure.

SUMMARY OF THE INVENTION

An object of the present invention is to solve the above problems, thereby providing an electron source substrate in which, even with occurrence of discharge between the anode and an electron-emitting device, the other electron-emitting devices are prevented from being negatively affected thereby, and display apparatus using it.

In order to achieve the above object, a first aspect of the present invention is an electron source substrate comprising:

row-directional wiring laid in a row direction;

column-directional wiring laid in a column direction so as to intersect with the row-directional wiring; and an electron-emitting device one end of which is coupled to the row-directional wiring, the other end of which is coupled through a first resistor element to the column-directional wiring, and to which a predetermined drive voltage is supplied through the row-directional wiring and column-directional wiring, wherein a wiring resistance of the column-directional wiring is higher than a wiring resistance of the row-directional wiring.

In the first aspect of the present invention described above, a drive circuit for supplying a drive voltage to the row-directional wiring is designed to have a current carrying capacity larger than that of a drive circuit for supplying a drive voltage to the column-directional wiring, and the output impedance thereof is set lower in connection therewith. According to this design condition, a more advantageous configuration in terms of design is such that the electric current flowing through the row-directional wiring is set greater than that through the column-directional wiring; therefore, the wiring resistance of the column-directional wiring is higher than the wiring resistance of the row-directional wiring and the first resistor element is placed between the electron-emitting device and the column-directional wiring. This configuration allows the discharge current to flow selectively through the row-directional wiring with the greater current carrying capacity, and is thus able to reduce the damage to the electron source.

In the first aspect of the present invention, a second resistor element may be placed between the electron-emitting device and the row-directional wiring, whereby, with occurrence of discharge on the row-directional wiring side of the electron-emitting device, the discharge current (abnormal current) caused by the discharge is restrained by the second resistor element. When discharge occurs on the row-directional wiring side of another electron-emitting device, the second resistor element also restrains the discharge current flowing through the row-directional wiring. When discharge occurs on the column-directional wiring side of the electron-emitting device, the first resistor element restrains the discharge current (abnormal current) caused by the discharge, as described above. When discharge occurs on the column-directional wiring side of another electron-emitting device, the first resistor element also restrains the discharge current flowing through the column-directional wiring. The configuration comprising the first and second resistor elements as described is able to keep down the damage due to the discharge current to the other electron-emitting devices in both the row direction and the column direction and keep down the damage due to the discharge current from the other electron-emitting devices.

In the first aspect of the present invention, the electron source substrate desirably satisfies the condition of $A/B \leqq C/D$, where A is a resistance of the first resistor element, B a resistance of the second resistor element, C the wiring resistance of the column-directional wiring, and D the wiring resistance of the row-directional wiring. In this case, it becomes feasible to better optimize the setting of the resistances of the first and second resistor elements in consideration of influence on the drive voltages.

A second aspect of the present invention is an electron source substrate comprising:

row-directional wiring laid in a row direction;

column-directional wiring laid in a column direction so as to intersect with the row-directional wiring; and an electron-emitting device one end of which is coupled to the row-directional wiring, the other end of which is coupled through first current restraining means to the column-directional wiring, and to which a predetermined drive voltage is supplied through the row-directional wiring and column-directional wiring, wherein a wiring resistance of the column-directional wiring is higher than a wiring resistance of the row-directional wiring.

According to the second aspect of the present invention described above, the discharge current restraining means allows the discharge current to flow through the row-directional wiring with the greater current carrying capacity, and is thus able to decrease the damage to the electron source, as in the first aspect of the present invention described above. Second current restraining means may be further provided between the electron-emitting device and the row-directional wiring, whereby the current restraining means restrains the discharge current from flowing out through the row-directional wiring and the column-directional wiring to the other electron-emitting devices. The current restraining means also restrains the discharge current from flowing in through the row-directional wiring and the column-directional wiring from the other electron-emitting devices. Accordingly, it is feasible to keep down the damage due to the discharge current to the other electron-emitting devices more securely and keep down the damage due to the discharge current from the other electron-emitting devices.

A third aspect of the present invention is an electron source substrate comprising:

row-directional wiring laid in a row direction;

column-directional wiring laid in a column direction so as to intersect with the row-directional wiring; and an electron-emitting device one end of which is coupled to the row-directional wiring, the other end of which is coupled through first voltage drop means to the column-directional wiring, and to which a predetermined drive voltage is supplied through the row-directional wiring and column-directional wiring, wherein a wiring resistance of the column-directional wiring is higher than a wiring resistance of the row-directional wiring.

According to the third aspect of the present invention, it is feasible to let the discharge current flow through the row-directional wiring with the greater current carrying capacity and decrease the damage to the electron source, as in the first aspect of the present invention. Second voltage drop means may be further provided between the electron-emitting device and the row-directional wiring, whereby, with occurrence of discharge at the electron-emitting device, the voltage drop means can drop the discharge voltage between the row-directional wiring and the column-directional wiring, so as to make smaller the discharge current flowing through the wiring to the other electron-emitting devices. When discharge occurs at another electron-emitting device, the voltage drop means is also able to drop the discharge voltage between the row-directional wiring and the column-directional wiring, so that the discharge current flowing through the wiring from the other electron-emitting device is kept small. Accordingly, it is feasible to keep down the damage due to the discharge current to the other electron-emitting devices more securely and keep down the damage due to the discharge current from the other electron-emitting devices.

Japanese Patent Applications Laid-Open No. 02-247936 and No. 02-247937 disclose the placement of the resistor element in series to the electron-emitting device in order to enhance the uniformity of characteristics of the electron-emitting device. The configurations described in these applications, however, are of ladder wiring, different from the configurations of the first to third aspects of the present invention. Therefore, they fail to describe the resistance of the resistor element placed in series to the electron-emitting device, and the wiring resistances of the row-directional wiring and column-directional wiring, and describe nothing about the problems and solutions in the case where discharge occurs in the display apparatus. It is thus not easy to come up with the technical concept of achieving both controlling the damage below a certain level even with occurrence of discharge anywhere in the display apparatus and decreasing the output voltages of the drive devices, from the disclosed examples.

Japanese Patent Application Laid-Open No. 07-326283 discloses the placement of the resistor element in series between a power supply and wiring coupled to a plurality of electron-emitting devices in order to enhance uniformity of characteristics of the electron-emitting devices. This is an example of disclosure of matrix wiring. However, the one described in this application is also different from the configurations of the first to third aspects of the present invention. The application teaches nothing about the case where discharge occurs in the display apparatus. Accordingly, it is impossible to come up with the technical concept of achieving both controlling the damage below the certain level even with occurrence of discharge anywhere in the display apparatus and decreasing the output voltages of the drive devices, from the above Applications Laid-Open No. 02-247936, No. 02-247937, and so on.

BRIEF DESCRIPTION OF THE DRAWINGS

FIGS. 1A, 1B, and 1C are diagrams for explaining an electron source substrate, which is an embodiment of the present invention, wherein FIG. 1A is an equivalent circuit diagram showing a basic circuit of matrix wiring of the electron source substrate, FIG. 1B a schematic diagram showing occurrence of an abnormal current in the case where discharge occurs at the device electrode on the column-directional wiring side of the electron-emitting device in the basic circuit shown in FIG. 1A, and FIG. 1C a schematic diagram showing occurrence of an abnormal current in the case where discharge occurs at the device electrode on the row-directional wiring side of the electron-emitting device in the basic circuit shown in FIG. 1A;

FIGS. 19A and 19B are diagrams showing a typical device configuration of the SCE device, wherein FIG. 19A is a top plan view and FIG. 19B a side view;

DETAILED DESCRIPTION OF THE PREFERRED EMBODIMENTS

Embodiments of the present invention will be described below with reference to the drawings.

Repeatedly, the object of the present invention is to avoid the negative effect on the other electron-emitting devices even with occurrence of discharge between the anode and an electron-emitting device. Conceivable approaches are to restrain the discharge current and to effect a voltage drop between a discharge location and the other electron-emitting devices.

First, by restraining the discharge current, it is feasible to prevent an over current from flowing into the other electron-emitting devices. The discharge current can be restrained by increasing the impedance of a discharge current path. The impedance can be increased, for example, by increasing the wiring resistance or by matching the inductance of wiring and the capacitance between wiring lines in accordance with discharge speed.

It is also possible to prevent an over voltage from being applied to the other electron-emitting devices, by effecting the voltage drop. The over voltage can be prevented, for example, by decreasing the impedance of an external circuit, or by capacitively coupling the two ends of the electron-emitting device to decrease the apparent impedance in accordance with the discharge speed.

Although there is a difference in the idea of managing either current or voltage between the over current preventing means and the over voltage preventing means, the current and the voltage are in a relation of dependence and almost all means are substantially of the same structure and achieve the both effects. For example, the resistor element coupled in series to the electron-emitting device, as described in the present embodiment, is a typical example and has both the current limiting function and the voltage drop function.

Figure 1A:
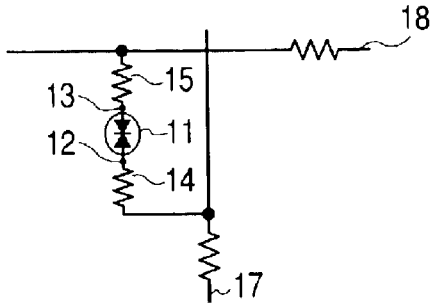
Figure 1B:
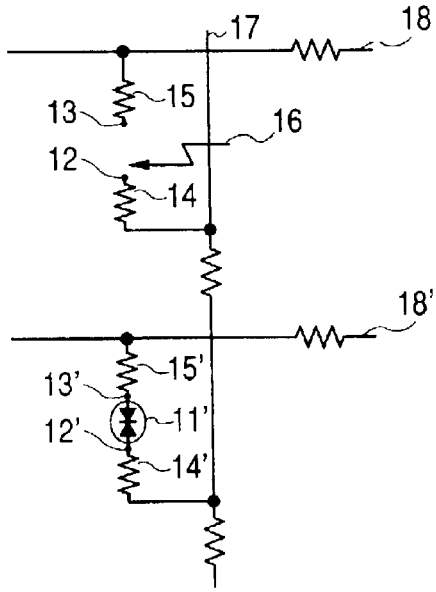
Figure 1C:
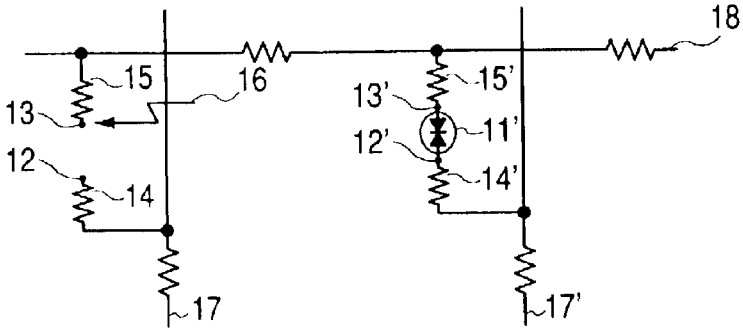

FIGS. 1A to 1C are diagrams for explaining an electron source substrate, which is an embodiment of the present invention, wherein FIG. 1A is an equivalent circuit diagram showing a basic circuit of matrix wiring in the electron source substrate, FIG. 1B a schematic diagram showing occurrence of an abnormal current in the case where discharge occurs at the device electrode on the column-directional wiring side of the electron-emitting device in the basic circuit shown in FIG. 1A, and FIG. 1C a schematic diagram showing occurrence of an abnormal current in the case where discharge occurs at the device electrode on the row-directional wiring side of the electron-emitting device in the basic circuit shown in FIG. 1A.

As shown in FIG. 1A, the basic circuit of matrix wiring in the electron source substrate of the present embodiment, has a row-directional wiring line 18 laid in the row direction, a column-directional wiring line 17 laid in the column direction so as to intersect therewith, and an electron-emitting device 11 placed near an intersection between these wiring lines. The electron-emitting device 11 has a pair of device electrodes, among which the device electrode 12 is coupled through a first resistor element 14 to the column-directional wiring 17 and the device electrode 13 is coupled through a second resistor element 15 to the row-directional wiring 18. In the electron source substrate of the present embodiment, circuits of the configuration similar to this configuration are arranged and wired in a matrix pattern.

In the above matrix wiring, during normal operation an information signal voltage is applied from the column-directional wiring 17 through the first resistor element 14 to one device electrode 12 of the electron-emitting device 11 and a scanning signal voltage is applied from the row-directional wiring 18 through the second resistor element 15 to the other device electrode 13. This results in applying a desired drive voltage to the electron-emitting device 11.

The following will describe with reference to FIG. 1B, the influence of the abnormal current in the column direction in the case where discharge occurred at the device electrode 12 on the column-directional wiring 17 side to break the electron-emitting device 11.

In FIG. 1B, the electron-emitting device 11 broken by discharge is indicated by only its device electrodes 12, 13. An electron-emitting device 11' is adjacent in the column direction to the electron-emitting device 11, and is provided with a pair of device electrodes 12', 13', among which one device electrode 12' is coupled through a first resistor element 14' to the column-directional wiring 17 and the other device electrode 13' is coupled through a second resistor element to another row-directional wiring line 18'. The row-directional wiring 18' is adjacent to the row-directional wiring 18.

In the case where discharge occurred at the device electrode 12 on the column-directional wiring 17 side to break the electron-emitting device 11, the abnormal current 16 generated by the discharge is limited by the first resistor element 14, as shown in FIG. 1B. This current limiting effect by the first resistor element 14 restrains the amount of the abnormal current 16 flowing out into the column-directional wiring 17. At the same time as it, the first resistor element 14 causes a voltage drop between the device electrode 12 and the column-directional wiring 17.

In the adjacent pixel along the column-directional wiring 17, an electric current flowing from the column-directional wiring 17 into the electron-emitting device 11' is limited by the first resistor element 14'. At the same time as it, the first resistor element 14' causes a voltage drop between the device electrode 12' and the column-directional wiring 17. This results in greatly decreasing the damage due to the discharge to the electron-emitting device 11' adjacent along the column-directional wiring 17.

The following will describe with reference to FIG. 1C, the influence of the abnormal current in the row direction in the case where discharge occurred at the device electrode 13 on the row-directional wiring 18 side to break the electron-emitting device 11.

In FIG. 1C, the electron-emitting device 11 broken by the discharge is indicated by only its device electrodes 12, 13. The electron-emitting device 11' is adjacent in the row direction to the electron-emitting device 11, and is provided with a pair of device electrodes 12', 13', among which one device electrode 12' is coupled through a first resistor element 14' to another column-directional wiring line 17' and the other device electrode 13' is coupled through a second resistor element 15' to the row-directional wiring 18. The column-directional wiring 17' is adjacent to the column-directional wiring 17.

In the case where discharge occurred at the device electrode 13 on the row-directional wiring 18 side of the electron-emitting device 11 to break the electron-emitting device 11, the abnormal current 16 caused by the discharge is limited by the second resistor element 15, as shown in FIG. 1C. This current limiting effect by the second resistor element 15 restrains the amount of the abnormal current 16 flowing out into the row-directional wiring 18. At the same time as it, the second resistor element 15 causes a voltage drop between the device electrode 13 and the row-directional wiring 18.

In the adjacent pixel along the row-directional wiring 18, an electric current flowing from the row-directional wiring 18 into the electron-emitting device 11' is limited by the second resistor element 15'. At the same time as it, the second resistor element 15' causes a voltage drop between the device electrode 13' and the row-directional wiring 18. This results in greatly decreasing the damage due to the discharge to the electron-emitting device 11' adjacent along the row-directional wiring 18.

As described above, the circuit configuration shown in FIGS. 1A to 1C decreases the abnormal current flowing out into the wiring electrode and drops the voltage, so as to restrain the damage to the electron-emitting device along the wiring electrode, even in the case where the discharge occurs at the device electrode on either side out of the pair of device electrodes of the electron-emitting device.

In the conventional configurations, if discharge occurs at either of the device electrode pair of a certain electron-emitting device, the abnormal current will flow through a wiring electrode coupled to the device electrode and will damage another electron-emitting device coupled to the wiring electrode. For this reason, there was a change in luminance on the display panel and it appeared as a defect of line shape or cross shape on the display screen, so as to be highly visible. In the present embodiment, however, only the electron-emitting device suffering discharge is damaged, and appears only as a defect of point shape on the display screen, without resulting in the defect of line shape or cross shape.

In the configuration of the present embodiment as described above, the effect of restraining the amount of abnormal current becomes more significant with increase in the resistances of the first and second resistor elements, while the voltage for driving the electron-emitting device needs to be increased with increase in the resistances. For example, in the circuit of FIG. 1B, let the resistance of the first resistor element 14 be x Ω, the resistance of the second resistor element 15 be y Ω, and the resistance of the electron-emitting device 11 be z Ω. Then, in order to apply the desired drive voltage to the electron-emitting device, it is necessary to apply the voltage (x+y+z)/z times higher between the column-directional wiring electrode 17 and the row-directional wiring electrode 18. This means that the necessary drive voltage becomes higher with increase in the resistances of the first resistor element 14 and the second resistor element 15 and the drive devices become larger in scale. Therefore, the resistances of the first resistor element 14 and the second resistor element 15 are desirably set at values as small as possible within the range where the influence of discharge can be restrained enough to avoid the damage to the electron-emitting device 11.

Figure 2:
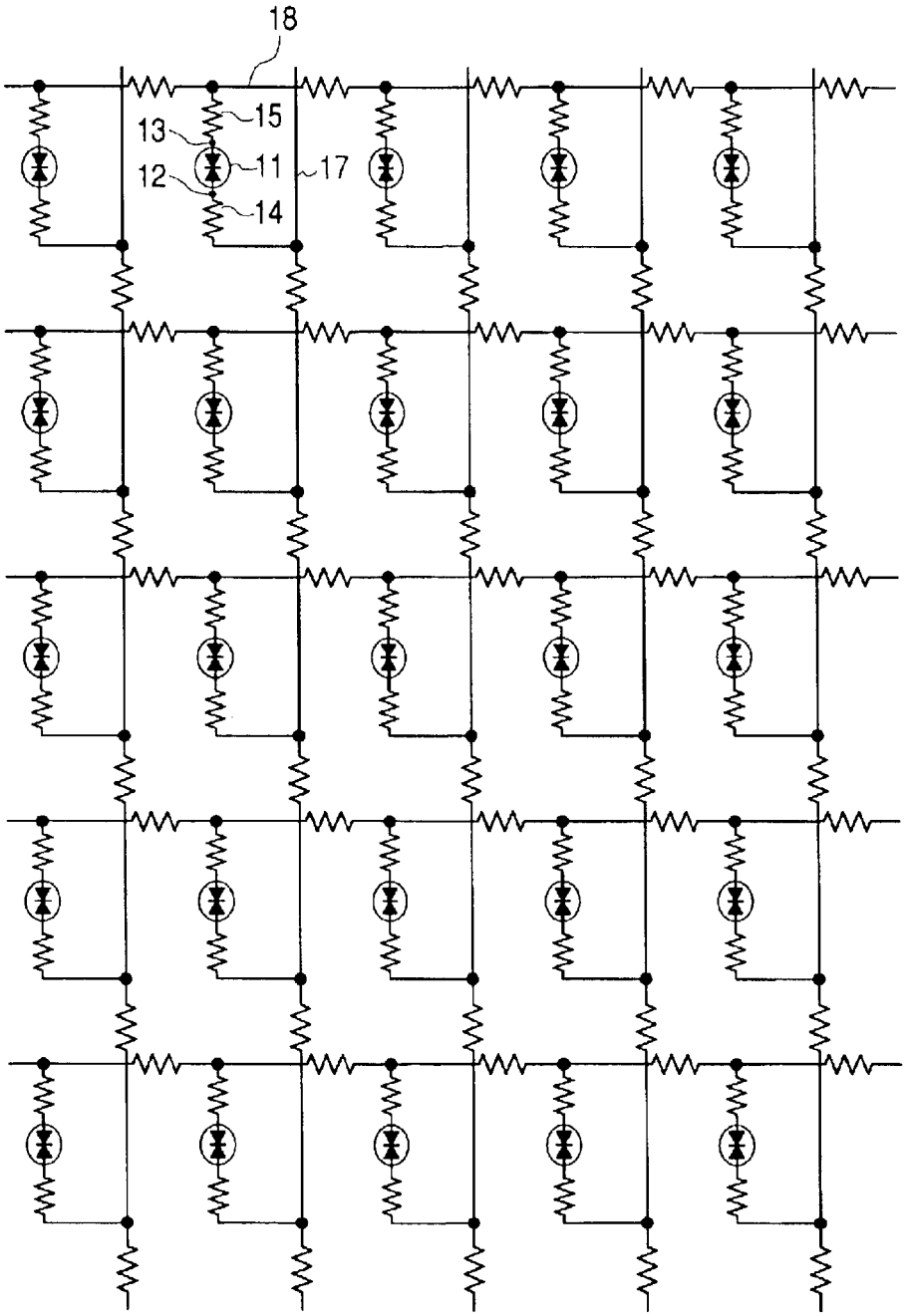
FIG. 2 is an equivalent circuit of an electron source substrate constructed in the circuit configuration shown in FIGS. 1A to 1C, which was used in electrical simulation.

The resistances of the first and second resistor elements coupled to each electron-emitting device in the above electron source substrate of the present embodiment will be described below in detail. The Inventor performed the electrical simulation based on SPICE (Simulation Program with Integrated Circuit Emphasis) to calculate potential distributions and current distributions during drive and during discharge and find out the optimal resistances from the results of the calculation. More precisely, the electron-emitting devices, matrix wiring, and the limiting elements introduced in the present invention are described by impedance, and practical design is conducted using an equivalent circuit taking account of self-inductance, mutual inductance, and capacitance in addition to the resistance. However, the description will be given using an equivalent circuit of resistance in order to simplify the description of the essence of the present invention. In that case, in consideration of temporal responses for the potential distribution and the current distribution, the current flowing into the electron-emitting device and the voltage applied thereto are practically evaluated as a voltage waveform and a current waveform and the design is performed in consideration of the amplitude and phase. However, they will be expressed as current and voltage in order to avoid complication of description. FIG. 2 shows a part of an equivalent circuit of the electron source substrate used in the electrical simulation.

The matrix wiring shown in FIG. 2 includes 3840×768 pixels in the configuration of the basic circuit shown in FIGS. 1A to 1C. The electron-emitting device 11 of each pixel has nonlinear characteristics, the device electrode 13 thereof is coupled through the second resistor element 15 to the row-directional wiring 18, and the device electrode 12 is coupled through the first resistor element 14 to the column-directional wiring 17. In the electrical simulation, the row-directional wiring 18 and the column-directional wiring 17 were represented by lumped constants and the resistor elements were assumed to be arranged at equal intervals in the respective pixels. The results of the electrical simulation proved the following.

(1) When discharge occurs at the device electrode 12 on the column-directional wiring 17 side, a voltage increase occurs in the column-directional wiring 17.

(2) When discharge occurs at the most distant position from the drive circuit (not shown) side of the column-directional wiring 17, the largest voltage increase occurs.

(3) When discharge occurs at the device electrode 12 on the column-directional wiring 17 side, increase in the resistance of the first resistor element 14 results in limiting the discharge current in the column-directional wiring 17 and restraining the increase amount of the voltage in the column-directional wiring 17.

(4) When discharge occurs at the device electrode 13 on the row-directional wiring 18 side, a voltage increase occurs in the row-directional wiring 18.

(5) When discharge occurs at the most distant position from the drive circuit (not shown) side of the row-directional wiring 18, the largest voltage increase occurs.

(6) When discharge occurs at the device electrode 13 on the row-directional wiring 18 side, increase in the resistance of the second resistor element 15 results in limiting the discharge current in the row-directional wiring 18 and restraining the increase amount of the voltage in the row-directional wiring 18.

(7) A resistance x of the first resistor element 14 and a resistance y of the second resistor element 15 necessary for controlling the increase amount of the voltage below a certain reference upon occurrence of discharge at the most distant position from each drive circuit in the column-directional wiring 17 and the row-directional wiring 18, are different from each other.

(8) A ratio of x to y is close to a ratio of the wiring resistance of the column-directional wiring 17 to the wiring resistance of the row-directional wiring 18.

(9) The output voltages from the drive circuits necessary for keeping constant the voltage applied to the electron-emitting device 11, decrease with decrease in the resistance of the first resistor element 14 and the resistance of the second resistor element 15.

The above verified that it became feasible to control the damage in the display surface below the certain reference and restrain the influence of the first and second resistor elements on the drive voltage, by setting the minimum resistance x of the first resistor element 14 necessary for controlling the damage below the certain reference in the case where discharge occurred in the device electrode 12 on the column-directional wiring 17 side at the most distant position from the drive circuit of the column-directional wiring 17 and from the drive circuit of the row-directional wiring 18 and setting the minimum resistance y of the second resistor element 15 necessary for controlling the damage below the certain reference in the case where the discharge occurred in the device electrode 13 on the row-directional wiring 18 side at the most distant position from the drive circuit of the column-directional wiring 17 and from the drive circuit of the row-directional wiring 18. Furthermore, Inventor also obtained the finding that the relationship between the minimum resistances x and y was close to the ratio of the wiring resistance of the column-directional wiring to the wiring resistance of the row-directional wiring.

In general, the matrix wiring in the case of color display is configured in display units of three-column wiring lines of R, G, and B per row line, and it is thus difficult to set the resistance of the column-directional wiring at the level comparable to the resistance of the row-directional wiring because of physical constraints such as the wiring width and others. Accordingly, the resistance of the first resistor element is desirably set higher than the resistance of the second resistor element.

Besides the damage to the electron-emitting device, it is also necessary to take the influence of discharge on the drive circuits into consideration. In general, drive circuits have their respective current carrying capacities, which are different between the row drive circuit and the column drive circuit. For example, on the row side, the drive current flows in the magnitude enough to drive all the devices in a selected row, so that the drive circuit is designed to flow the instantaneous current of approximately 1 A to 10 A at the surface conduction electron-emitting devices. On the other hand, on the column side, the drive current flows in the magnitude enough to drive selected devices, so that the drive circuit is designed so as to flow the instantaneous current of approximately 0.2 mA to 2 mA at the surface conduction electron-emitting devices. Namely, the row drive circuit has the current carrying capacity greater than that of the column drive circuit. In connection therewith, the output impedance of the row drive circuit is designed to be lower than that of the column drive circuit. Accordingly, the amount of current flowing in from the row wiring is preferably set greater than that from the column wiring, in terms of the drive circuits.

From the above, in consideration of both the damage to the electron-emitting devices and the current carrying capacities and impedances of the drive circuits, it is desirable to satisfy the relation of $A/B \leqq C/D$, rather than $A/B \simeq C/D$, where A is the resistance of the first resistor element between the electron-emitting device and the column-directional wiring, B the resistance of the second resistor element between the electron-emitting device and the row-directional wiring, C the wiring resistance of the column-directional wiring, and D the wiring resistance of the row-directional wiring.

According to the result of the electrical simulation, the damage caused by the discharge is affected by the voltage of the anode electrode and the distance between the anode electrode and the electron-emitting device. This is presumably because the amount of charge accumulated in the face plate, which is a source of discharge current, varies depending upon the voltage of the anode and the distance between the anode and the electron-emitting device. On the presupposition that the voltage increase due to the discharge should be controlled below the maximum voltage of 20 V in the activation step described hereinafter and under the setting conditions that the voltage of the anode was in the range of 1 kV to 10 kV and the distance between the anode and the electron-emitting device in the range of 2 mm to 8 mm, the resistances necessary for controlling the voltage increase below the reference were determined as follows: the resistance of the first resistor element was 1 kΩ to 50 kΩ and the resistance of the second resistor element 200 Ω to 10 kΩ.

During application of the voltage to the column-directional wiring or to the row-directional wiring, the resistances of the first and second resistor elements necessary for controlling the damage below the certain reference vary from those without application of the voltage. This is because the electron-emitting device is preliminarily offset by the applied voltage (drive voltage) relative to the voltage value to cause the damage. The above provided the fundamental description to describe the action of restraining the damage to the electron-emitting device by restraining the current flowing into the electron-emitting device and restraining the voltage applied to the electron-emitting device by the voltage drop, against the discharge current and abnormal voltage caused by the discharge. However, the present invention is by no means intended to be limited to this. The spirit of the present invention is to control the waveform of the current flowing into the electron-emitting device and the waveform of the voltage applied thereto by the current restraining means and the voltage drop means such as the impedance elements or the like including the resistors to restrain the damage to the electron-emitting device to below the predetermined value. Accordingly, for example, it is also feasible to implement optimization of achieving a balanced damage pattern, for example, by controlling relaxation of damage according to the specifications of the display apparatus by the values of the matrix wiring resistances and the characteristics of the electron-emitting devices. It is also possible to realize the value of the current restraining means to equalize the amount of discharge current flowing out from the electron-emitting device with the amount of discharge current flowing in because of discharge. Likewise, it is also feasible to control the voltage applied to the electron-emitting device because of the abnormal voltage caused by discharge, at the voltage waveform level including the amplitude and phase, as described previously, to control the maximum amplitude of the applied voltage below a predetermined value, and to implement optimization of a balance of damage by equalizing applied voltages during discharge among the electron-emitting devices.

Examples of the electron source substrate according to the above embodiment will be described below in detail.

EXAMPLE 1

Figure 3:
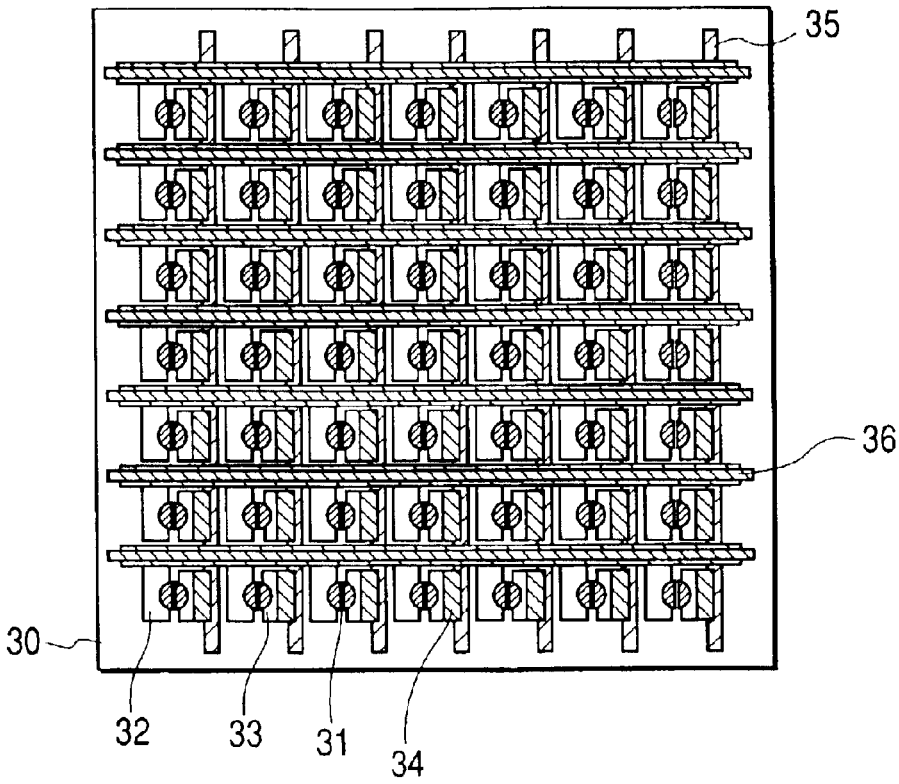
FIG. 3 is a schematic diagram showing a schematic configuration of a matrix wiring section as an embodiment of the electron source substrate according to the present invention.

FIG. 3 is a schematic diagram showing a schematic configuration of the matrix wiring portion as an example of the electron source substrate according to the present invention. In FIG. 3, the electron-emitting devices 31, paired device electrodes 32, 33, first resistor elements 34, column-directional wiring lines 35, and row-directional wiring lines 36 are similar to those described with the aforementioned equivalent circuit diagram and are formed on the electron source substrate (rear plate) 30. Each electron-emitting device 31 has a pair of device electrodes 32, 33 and a device film is formed so as to connect these device electrodes. The device electrode 33 is coupled to the first resistor element 34, and the device electrode 32 to the second resistor element not shown. The second resistor element is located in a through hole formed in an insulating layer and is thus not shown in FIG. 3.

A method of producing this rear plate 30 will be described in order. FIGS. 4 to 9 are schematic diagrams showing steps in the procedure of producing the rear plate. The production procedure will be described below referring to these FIGS. 4 to 9.

Formation of Substrate

In the present example, the glass substrate 40 of the rear plate 30 was prepared in a form in which a base was a 2.8 mm-thick glass sheet of PD-200 (available from Asahi Glass Co., Ltd.) containing a small amount of an alkali component and in which the glass base was coated with an $SiO_2$ film 100 nm thick as a sodium blocking layer, followed by baking.

Figure 4:
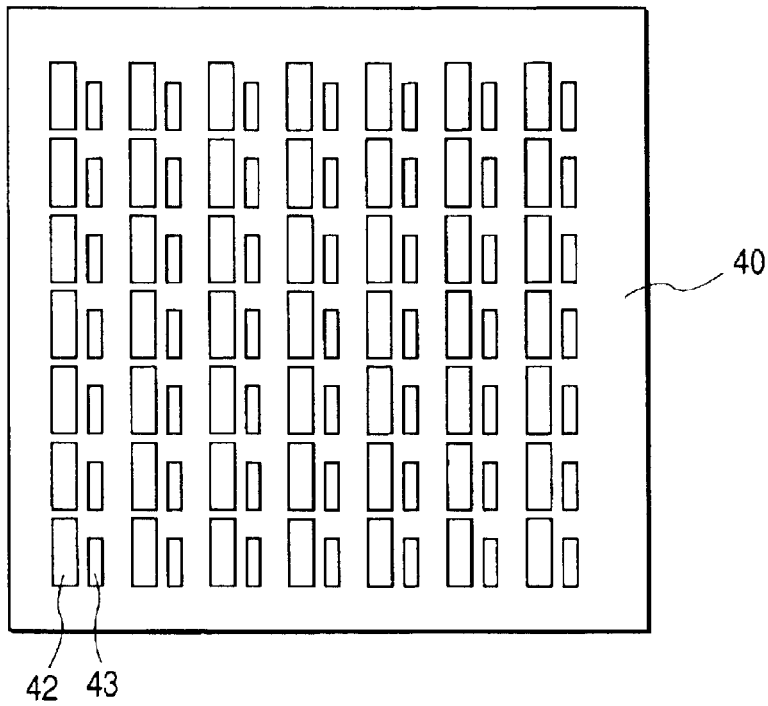
FIG. 4 is a diagram for explaining a fabrication step of the rear plate making use of the electron source substrate of the present invention.

First, as shown in FIG. 4, the pairs of device electrodes 42, 43 were formed in a matrix pattern on the above-stated glass substrate 40. The device electrodes 42, 43 were formed by first depositing a titanium (Ti) film 5 nm thick as an underlying layer, then depositing a platinum (Pt) film 40 nm thick thereon, thereafter coating the entire surface with a photoresist, and patterning the films by the sequential photolithography process of exposure, development, and etching. In the present example, the spacing L between the device electrodes 42, 43 was 10 μm. The length W of each device electrode was properly selected.

Formation of Lower Wiring

The wiring material for the row wiring and the column wiring desirably has a low resistance enough to supply an almost uniform voltage to a number of SCE devices and the material, thickness, wiring width, etc. are properly determined in consideration thereof.

Figure 5:
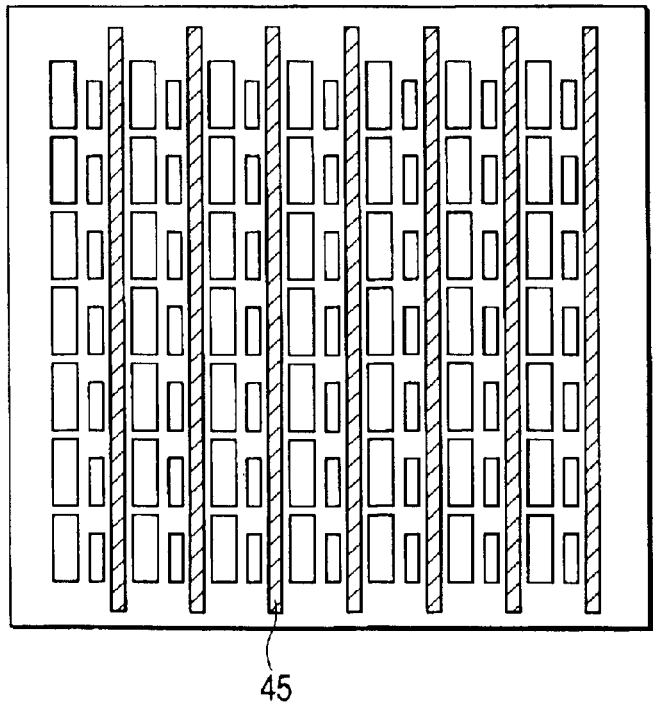
FIG. 5 is a diagram for explaining a fabrication step of the rear plate making use of the electron source substrate of the present invention.

The column-directional wiring (lower wiring) 45 as common wiring lines was formed in line patterns so as to be parallel to the device electrode pairs arranged in the column direction and so as to connect those device electrode pairs, as shown in FIG. 5. In this formation of the patterns, for example, photopaste ink of silver (Ag) was used as a material. It was printed by screen printing, thereafter was dried, was exposed in the predetermined patterns, and was developed. After that, the paste was baked at temperatures around 480° C. to form the wiring. The wiring thickness was about 10 μm and the wiring width 20 μm. Since the terminal ends were used as wiring outgoing electrodes, the width thereof was greater than that of the other portions. The column-directional wiring formed in this way had the resistance of 100 Ω.

Formation of First Resistor Elements

Figure 6:
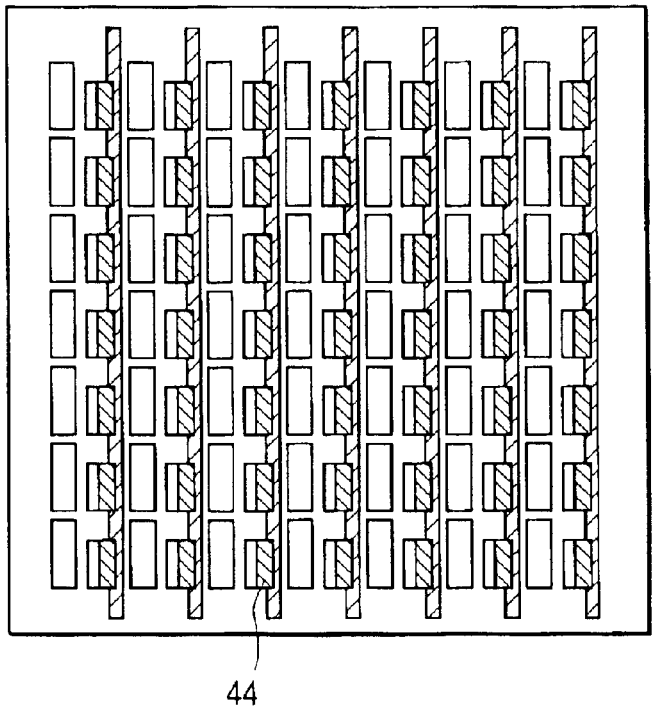
FIG. 6 is a diagram for explaining a fabrication step of the rear plate making use of the electron source substrate of the present invention.

Then the first resistor elements 44 were formed between the column-directional wiring 45 and the device electrodes 43, as shown in FIG. 6. In this formation of the resistor elements, for example, a nichrome alloy was deposited by evaporation and thereafter unnecessary portions were removed by photoetching. The size of the first resistor elements 44 was approximately equal to the size of the device electrodes 43. The resistance through the first resistor element 44 formed in this way, between the column-directional wiring 45 and the device electrode 43 was 5 kΩ.

Formation of Insulating Films

Figure 7:
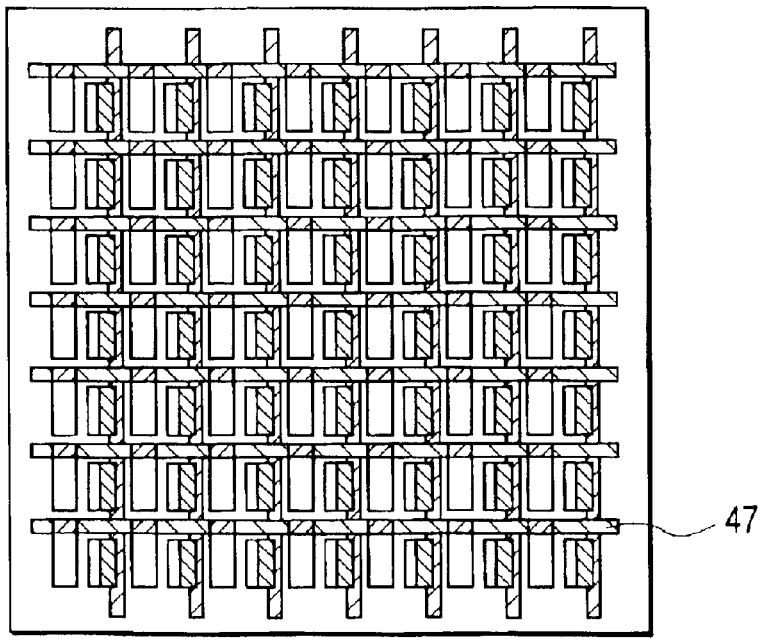
FIG. 7 is a diagram for explaining a fabrication step of the rear plate making use of the electron source substrate of the present invention.

As shown in FIG. 7, interlayer dielectric layers 47 were placed in order to insulate the column-directional wiring 45 from the row-directional wiring to be formed thereon, which will be described hereinafter. The interlayer dielectric layers 47 were formed below the row-directional wiring (upper wiring) described hereinafter so as to cover the intersections with the column-directional wiring 45 (lower wiring) formed previously and with such contact holes perforated at connections as to enable electrical connections between the row-directional wiring (upper wiring) and the device electrodes 42. In this formation of the interlayer dielectric layers 47, for example, steps of screen-printing a photosensitive glass paste containing the main component of PbO and thereafter performing exposure and development were repeated four times, and the paste was finally baked at temperatures around 480° C. The total thickness of the interlayer dielectric layers 47 was about 30 μm and the width 150 μm.

Formation of Second Resistor Elements

Figure 8:
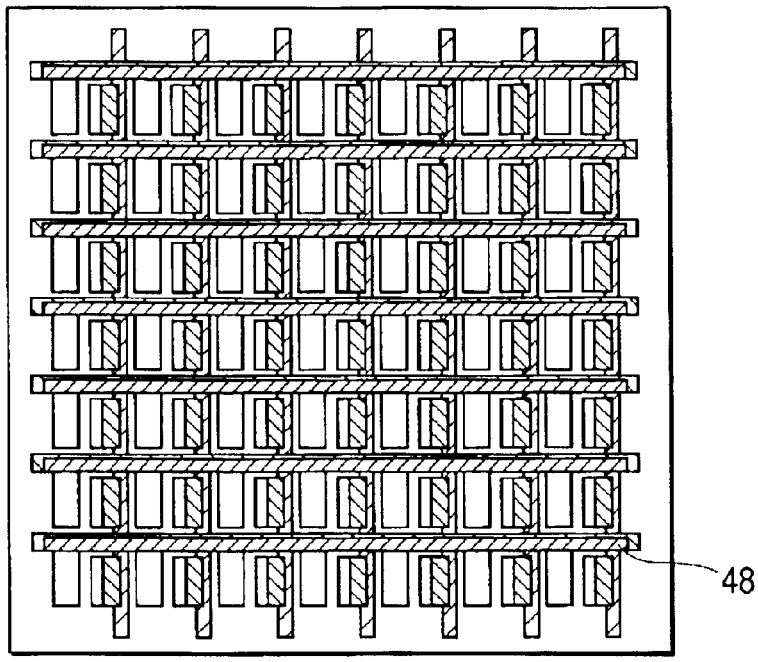
FIG. 8 is a diagram for explaining a fabrication step of the rear plate making use of the electron source substrate of the present invention.

As shown in FIG. 8, the second resistor elements 48 were placed between the row-directional wiring described hereinafter and the device electrodes 42. In this formation of the second resistor elements 48, a paste of $RuO_2$ was printed at the aforementioned contact hole portions, was dried, and was baked at temperatures around 450° C. The resistance through the second resistor element 48 formed in this way, between the row-directional wiring and the device electrode 42 was 2 kΩ.

Formation of Upper Wiring

Figure 9:
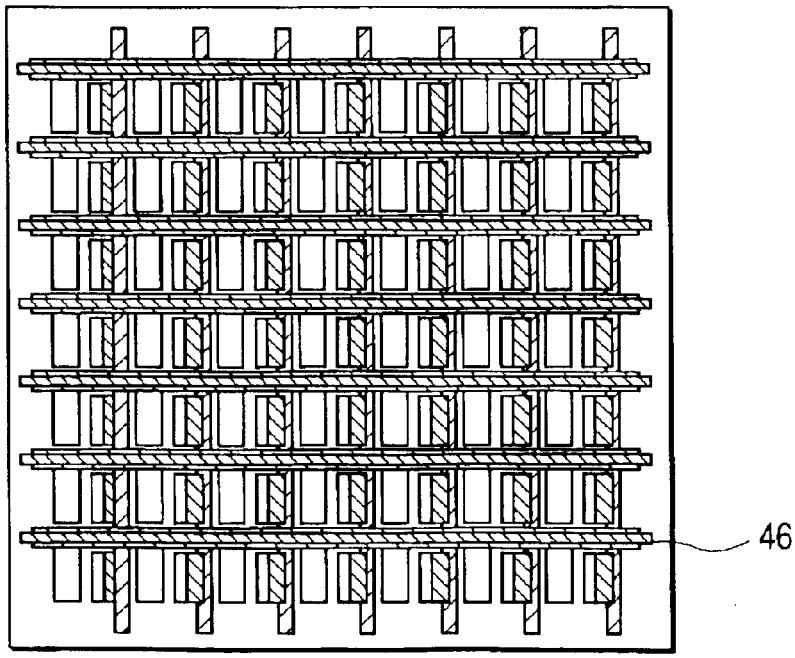
FIG. 9 is a diagram for explaining a fabrication step of the rear plate making use of the electron source substrate of the present invention.

As shown in FIG. 9, the row-directional wiring (upper wiring) 46 was formed on the interlayer dielectric films 47 formed previously. In this formation of the row-directional wiring 46, Ag paste ink was printed by screen printing and then was dried. The same steps were carried out again thereon to achieve double coatings, and then the paste was baked at temperatures around 480° C. The thickness of the row-directional wiring 46 was about 15 μm. Although not illustrated in FIG. 9, outgoing wiring to the external drive circuits and outgoing terminals to the external drive circuits were also formed by the method similar to the above method. The row-directional wiring 46 formed in this way had the resistance of 4 Ω.

The substrate with the matrix wiring was formed by successively carrying out the formation of substrate, formation of lower wiring, formation of first resistor elements, formation of insulating films, formation of second resistor elements, and formation of upper wiring as described above.

Formation of Device Films

Figure 10:
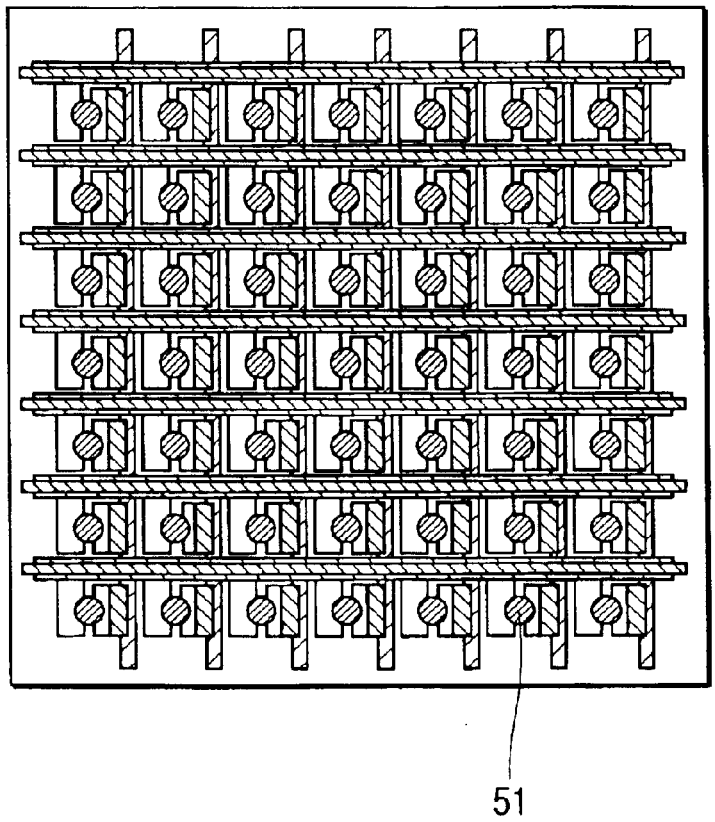
FIG. 10 is a diagram for explaining a fabrication step of the rear plate making use of the electron source substrate of the present invention.

The substrate with the matrix wiring was cleaned well, and thereafter the surface was processed with a solution containing a water repellent agent to make the surface hydrophobic. This was done for the purpose of allowing an aqueous solution for formation of device films applied subsequently, to be placed with a moderate spread over the device electrodes. Thereafter, the device films 51 were formed between the device electrodes by the ink jet applying method, as shown in FIG. 10.

Figure 11A:
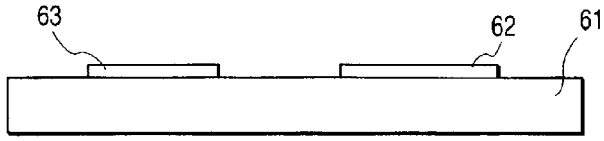
FIGS. 11A, 11B, 11C, and 11D are diagrams for explaining a sequential process from formation of device films to forming operation of the electron source substrate of the present invention.
Figure 11B:
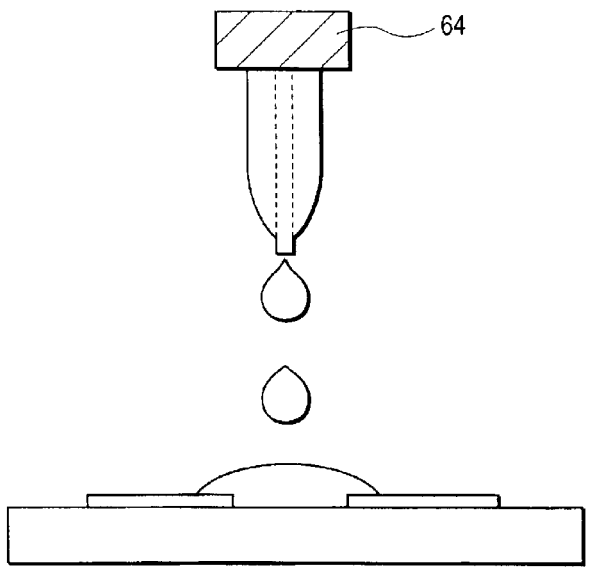

FIGS. 11A and 11B schematically show steps of forming the device films. In FIG. 11A, numeral 61 designates the glass substrate and 62, 63 the device electrodes.

In the present example, in order to obtain palladium films as the device films, a palladium-proline complex (0.15 wt %) was first dissolved in an aqueous solution in which water and isopropyl alcohol (IPA) was mixed at the ratio of 85:15, thus obtaining an organic palladium-containing solution. In addition thereto, a small amount of an additive was added.

Droplets of the above solution were delivered to between the device electrodes 62, 63, for example, using a droplet delivering means 64 comprised of an ink jet discharging device using a piezoelectric device and adjusting the dot size to 60 μm (cf. FIG. 11B). After that, this substrate was subjected to a heat baking process in air and at 350° C. for ten minutes to obtain palladium oxide (PdO). The films were obtained in the dot diameter of about 60 μm and in the maximum thickness of 10 nm.

The above steps resulted in forming the palladium oxide (PdO) films (electroconductive thin films 65) at the device portions.

Reduction Forming

Figure 11C:
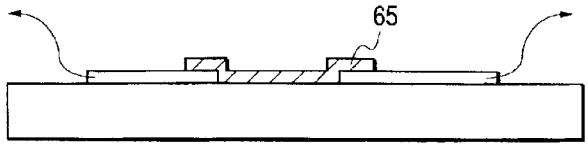
Figure 11D:
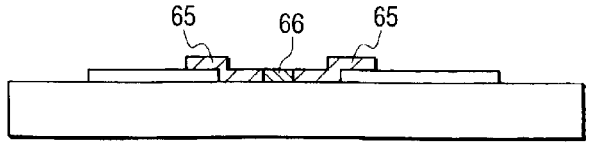

In the present step called forming, the above electroconductive thin films 65 were then subjected to the energization operation to form a fissure inside, thereby forming the electron-emitting regions. FIGS. 11C and 11D schematically show the step of reduction forming.

In this reduction forming, specifically, a hoodlike lid was placed so as to cover the entire substrate except for the outgoing electrode portions around the substrate 61 to form a vacuum space inside between the lid and the substrate, and a voltage was placed between the row-directional wiring and the column-directional wiring through the electrode terminal portions from an external power supply to implement energization between the device electrodes 62, 63 (cf. FIG. 11C). This energization operation locally broke, deformed, or modified the electroconductive thin films 65, thereby forming the electron-emitting regions 66 in an electrically high resistance state (FIG. 11D).

During the above energization, if the energization and heating is done under a vacuum atmosphere containing a small amount of hydrogen gas, hydrogen will promote reduction to change palladium oxide (PdO) into palladium (Pd) films. During this change, reduction constriction of each film occurs to make a fissure in part, thereby forming an electron-emitting region 66. The resistance of the resulting conductive films 65 was in the range of $10^2$ to $10^7$ Ω.

The following will briefly describe voltage waveforms used in the forming operation.

Figure 12A:
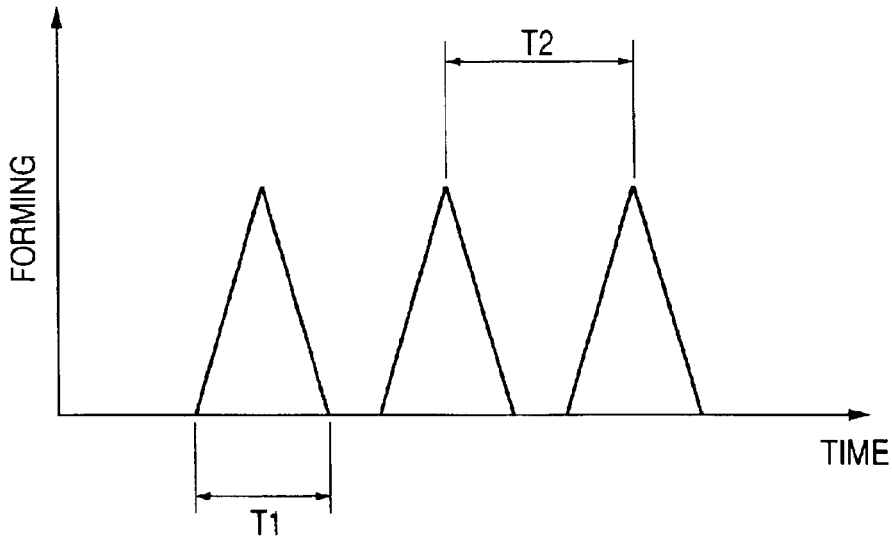
FIGS. 12A and 12B are waveform diagrams showing examples of voltage waveforms applied in the forming operation of the electron source substrate of the present invention.
Figure 12B:
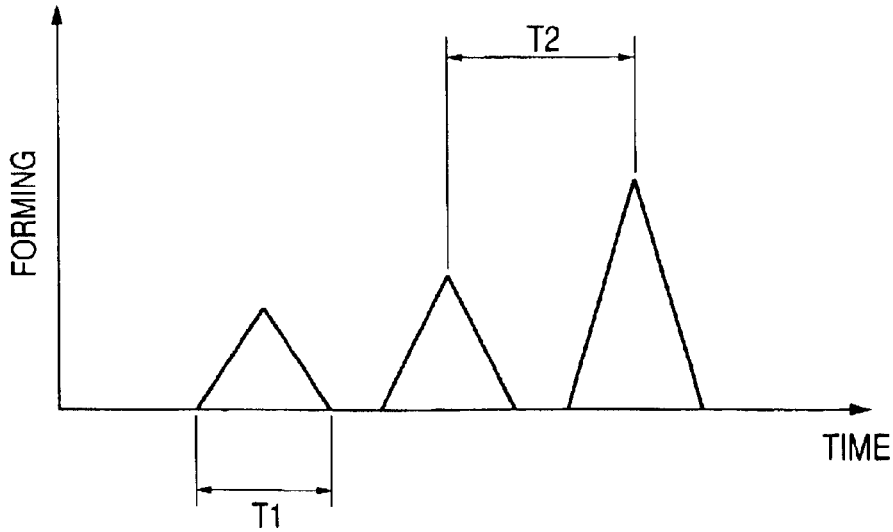

FIGS. 12A, 12B show examples of the voltage waveforms used in the forming operation. The forming operation using the applied voltage of pulse waveform is generally classified under the method of applying pulses with a pulse peak height of a constant voltage as shown in FIG. 12A and the method of applying pulses with increasing pulse peak heights as shown in FIG. 12B.

In FIG. 12A, T1 represents the pulse width of the voltage waveform and T2 the pulse spacing. In this example, the pulse width T1 is set in the range of 1 μsec to 10 msec, the pulse spacing T2 in the range of 10 μsec to 100 msec, and the peak height of triangular waves (the peak voltage in the forming) is properly selected.

In the example of FIG. 12B, the pulse width T1 and the pulse spacing T2 are the same as those in the above example of FIG. 12A, but the peak heights of triangular waves (peak voltages in the forming) are increased, for example, by steps of about 0.1 V.

In the forming operation, voltages weak enough to avoid local breakage or deformation of the conductive film 65, e.g., pulse voltages of about 0.1 V were put between the forming pulses, the device current was measured to calculate a resistance from the result of the measurement, and the operation was ended at the time when the resistance value thus calculated demonstrated the resistance 1000 times greater than the resistance before the forming operation, for example.

Activation-Carbon Deposition

As described previously, the devices in the state immediately after the above forming operation demonstrate very low electron emission efficiency. In order to increase the electron emission efficiency, it is thus desirable to perform an operation called activation on the devices. In this operation, a vacuum space is also made inside between the substrate and the hoodlike lid, as in the case of the above forming, under an adequate vacuum degree containing an organic compound, and pulse voltages are repeatedly applied from the outside through the wiring electrodes to the device electrodes. Then a gas containing carbon atoms is introduced into the vacuum space whereby carbon or carbon compounds deriving therefrom are deposited as carbon films near the aforementioned fissures.

In this activation step, for example, tolunitrile as a carbon source was introduced through a slow leak valve into the vacuum space and the interior was maintained at $1.3\times10^{-4}$ Pa. The pressure of tolunitrile introduced is slightly affected by the shape of the vacuum chamber, members used in the vacuum chamber, etc., and the pressure is preferably determined in the range of approximately $1\times10^{-5}$ Pa to $1\times10^{-2}$ Pa.

Figure 13A:
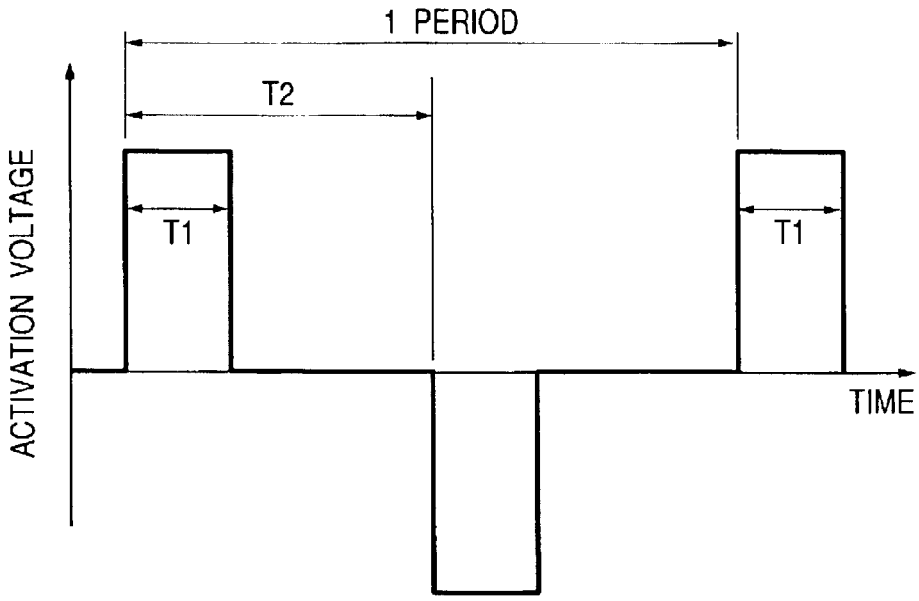
FIGS. 13A and 13B are diagrams showing preferred examples of voltages applied in an activation step.
Figure 13B:
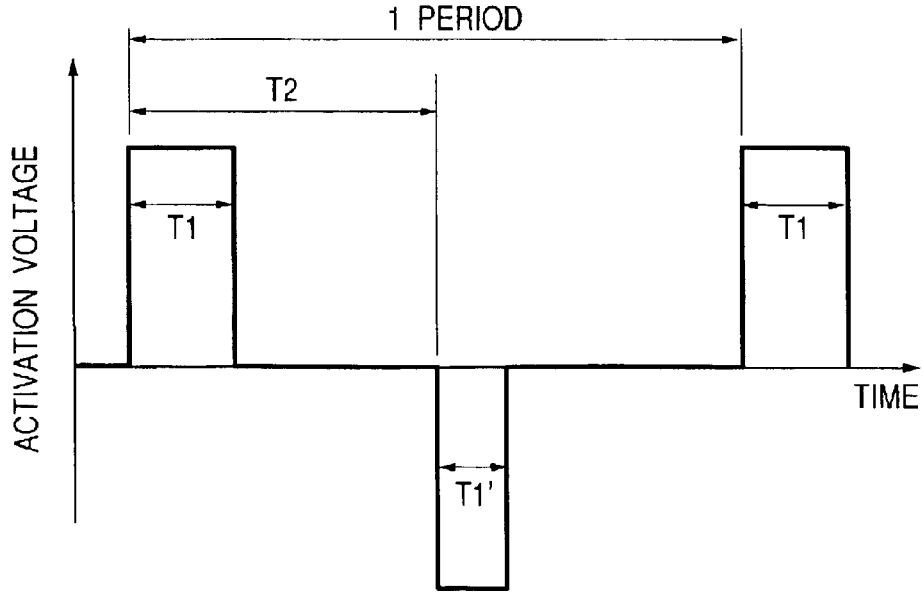

FIGS. 13A and 13B show preferred examples of voltages applied in the activation step. The maximum voltage applied is properly selected in the range of 10 to 20 V. In FIG. 13A, T1 represents the width of positive and negative pulses in the voltage waveform, T2 the pulse spacing, and the voltage values are set so that absolute values of positive and negative pulses are equal to each other. In FIG. 13B, T1 and T1' represent the width of the positive pulses and the width of the negative pulses, respectively, in the voltage waveform, T2 the pulse spacing, T1>T1', and the voltage values are set so that absolute values of positive and negative pulses are equal to each other. When the emission current Ie became almost saturated after a lapse of about 60 minutes, the energization was stopped, and the slow leak valve was closed, thereby ending the activation operation.

Through the above steps, the electron source substrate with the electron source devices was successfully fabricated.

Characteristics of Substrate

The following will describe the basic characteristics of the electron-emitting devices in the electron source substrate fabricated through the production procedure as described above.

Figure 14:
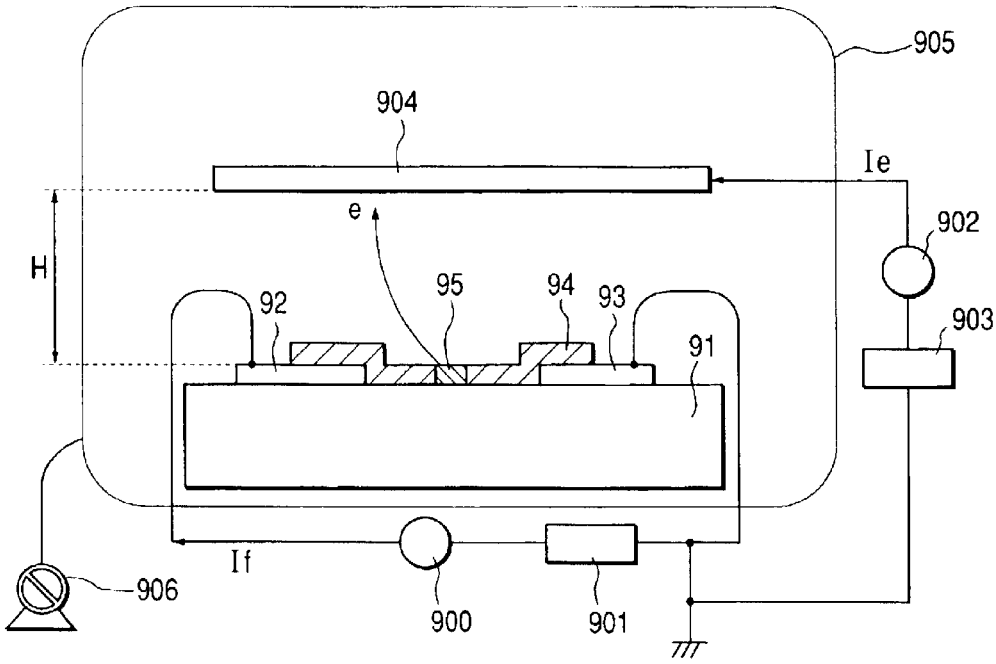
FIG. 14 is a schematic diagram of a measurement-evaluation system for measuring electron emission characteristics of the SCE devices in the electron source substrate of the present invention.

FIG. 14 is a schematic illustration of a measurement-evaluation system for measuring the electron emission characteristics of the SCE devices in the aforementioned electron source substrate. In FIG. 14, numeral 91 designates a substrate portion, 92 and 93 device electrodes, 94 a thin film including an electron-emitting region, and 95 the electron-emitting region. Numeral 901 denotes a power supply for applying the device voltage Vf to the electron-emitting device; 900 an ammeter for measuring the device current If flowing through the conductive thin film 94 including the electron-emitting region between the device electrodes 92, 93; 904 an anode for capturing the emission current Ie emitted from the electron-emitting region 95 of the device; 903 a high voltage supply for applying a voltage to the anode 904; and 902 an ammeter for measuring the emission current Ie emitted from the electron-emitting region 95 of the device.

The electron-emitting device and the anode 904 are set in a vacuum chamber, and the vacuum chamber is equipped with devices necessary for the vacuum chamber, such as an evacuation pump 906, a vacuum gage, etc., so as to be able to implement measurement and evaluation of the device under a desired vacuum. The anode 904 is placed above the electron-emitting device and the power supply 903 and the ammeter 902 are connected thereto. For measuring the device current If flowing between the device electrodes of the electron-emitting device and the emission current Ie to the anode, the power supply 901 and the ammeter 900 are coupled to the device electrodes 92, 93. The voltage of the anode was set in the range of 1 kV to 10 kV, and the distance H between the anode and the electron-emitting device in the range of 2 mm to 8 mm.

Figure 15:
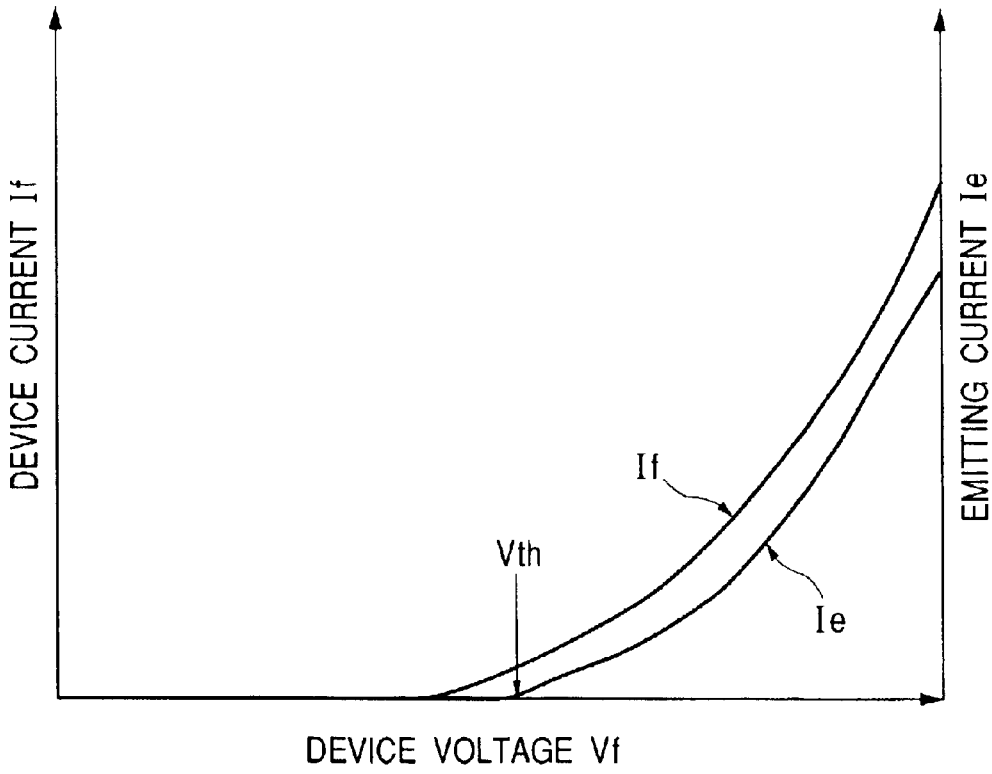
FIG. 15 is a characteristic diagram showing a typical example of relationship of the device voltage Vf with the emission current Ie and the device current If measured by the measurement-evaluation system shown in FIG. 14.

FIG. 15 is a characteristic diagram showing a typical example of relationship of the device voltage Vf with the emission current Ie and the device current If of the electron-emitting devices in the electron source substrate of the present invention, which was measured by the measurement-evaluation system shown in FIG. 14. Although the emission current Ie and the device current If are considerably different in magnitude from each other, they are plotted in arbitrary units on the vertical axis of linear scale, for qualitative comparison of changes of If and Ie in the example of FIG. 15. As seen from the result of the measurement, when the emission current Ie was measured at the voltage of 12 V applied between the device electrodes, the emission current Ie was 0.6 μA on average and the electron emission efficiency 0.15% on average. Uniformity was good among the devices and dispersion of Ie among the devices was also a good value of 5%.

Seal Bonding-Panel Assembly

The following will describe an example of an electron source using the electron source substrate of passive matrix arrangement as described above, and an image display apparatus used for display and the like.

Figure 16:
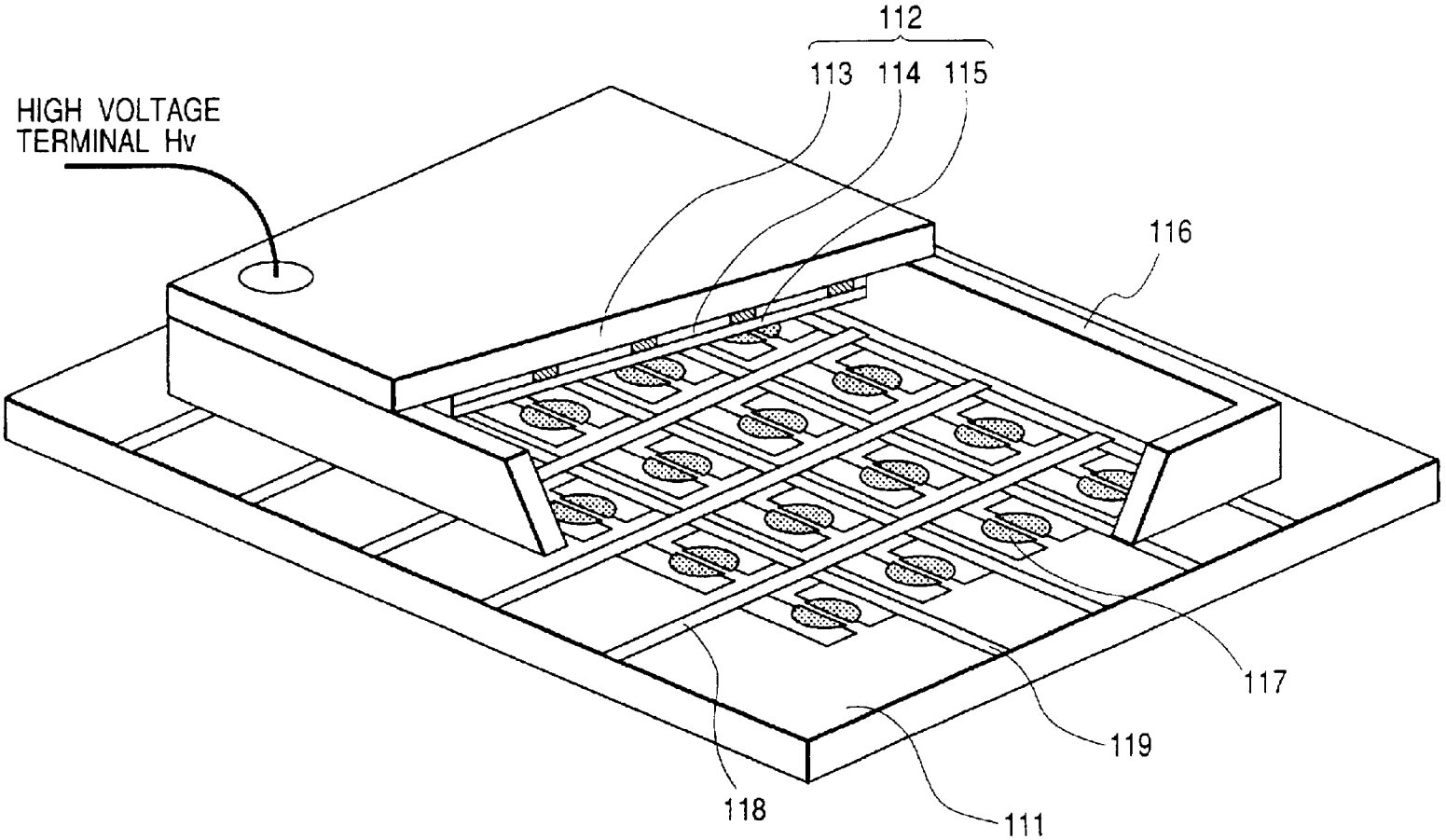
FIG. 16 is a schematic configuration diagram showing an example of an image display apparatus provided with the electron source substrate of the present invention.

FIG. 16 is a schematic configuration diagram showing an example of the image display apparatus provided with such an electron source substrate. In FIG. 16, numeral 111 designates the electron source substrate (rear plate) with a number of electron-emitting devices therein, in which diode devices are built. Numeral 112 indicates a face plate in which a fluorescent film 114, a metal back 115, etc. are formed on an internal surface of glass substrate 113, and numeral 116 a support frame. The rear plate 111, the support frame 116, and the face plate 112 are bonded with frit glass, and are baked at 400° C. to 500° C. for ten or more minutes to effect seal bonding thereof, thereby constituting an envelope. The series of steps are carried out all in a vacuum chamber, which simultaneously enables the interior of the envelope to be kept in vacuum from the beginning and enables the steps to be simplified.

The electron-emitting devices (SCE devices) 117 are formed in the rear plate 111 by the production steps as described previously, and the row-directional wiring line 118 and the column-directional wiring line 119 are coupled to the pair of device electrodes in each electron-emitting device 117. An unrepresented support called a spacer is placed between the face plate 112 and the rear plate 111, and this configuration permits the envelope to be provided with sufficient strength against the atmospheric pressure even in the case of a large-area panel.

Figure 17A:
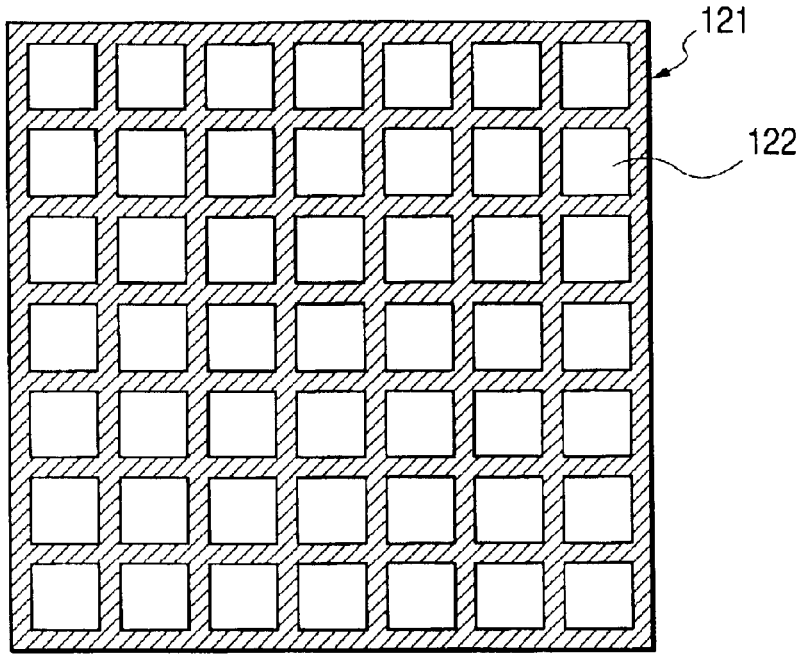
FIGS. 17A and 17B are schematic diagrams of fluorescent films to be provided on the face plate applied to the image display apparatus shown in FIG. 16.
Figure 17B:
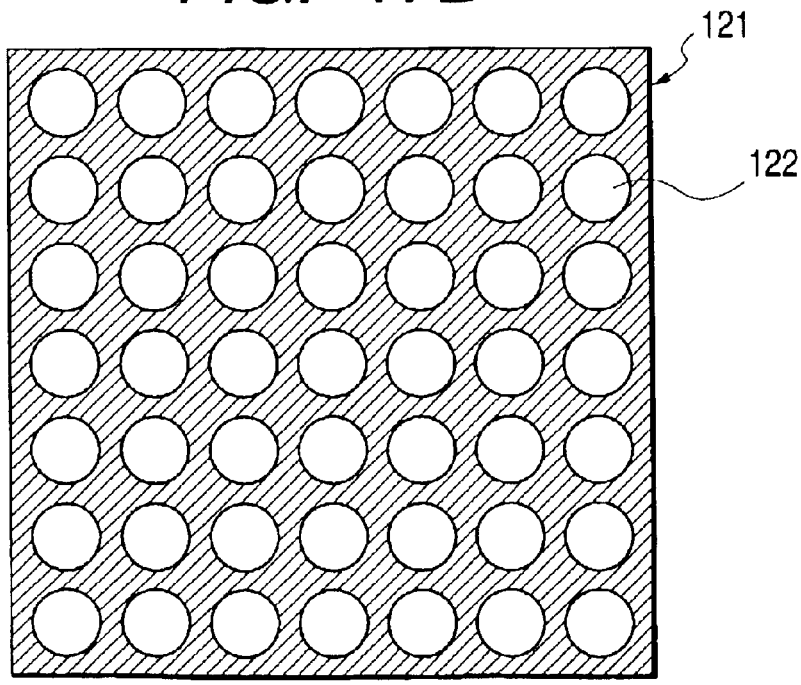

FIGS. 17A and 17B are schematic illustrations of fluorescent films to be placed on the face plate applied to the image display apparatus shown in FIG. 16.

The degree of vacuum during the seal bonding is required to be the vacuum of approximately $10^{-5}$ Pa, and, in addition thereto, getter processing is also performed in certain cases, in order to maintain the degree of vacuum after the seal processing of the envelope. The getter processing is, for example, a process of heating a getter placed at a predetermined position (not shown) in the envelope by a heating method of resistance heating, high-frequency heating, or the like immediately before the sealing of the envelope or after the sealing, to form a deposited film. In this case, the getter normally contains the main component of Ba or the like, and it is possible to maintain the vacuum, for example, at $10^{-3}$ to $10^{-5}$ Pa by adsorption action of the deposited film.

Image Display Device

According to the aforementioned fundamental characteristics of the SCE device in the present invention, the electrons emitted from the electron-emitting region are controlled by the peak height and width of pulsed voltage placed between the opposed device electrodes in the range over the threshold voltage, and the current can also be controlled by intermediate values thereof, thus implementing halftone display. In the case of a number of electron-emitting devices being arranged, a voltage can be properly applied to any device so as to turn each device on, by determining a selection line by a scanning line signal of each line and properly applying the aforementioned pulsed voltage to individual devices through each information signal line. Methods of modulating the electron-emitting devices according to input signals with halftone include the voltage modulation method and the pulse width modulation method.

The following will describe a schematic configuration of a drive system for driving the image display apparatus equipped with the electron source substrate of the present invention.

Figure 18:
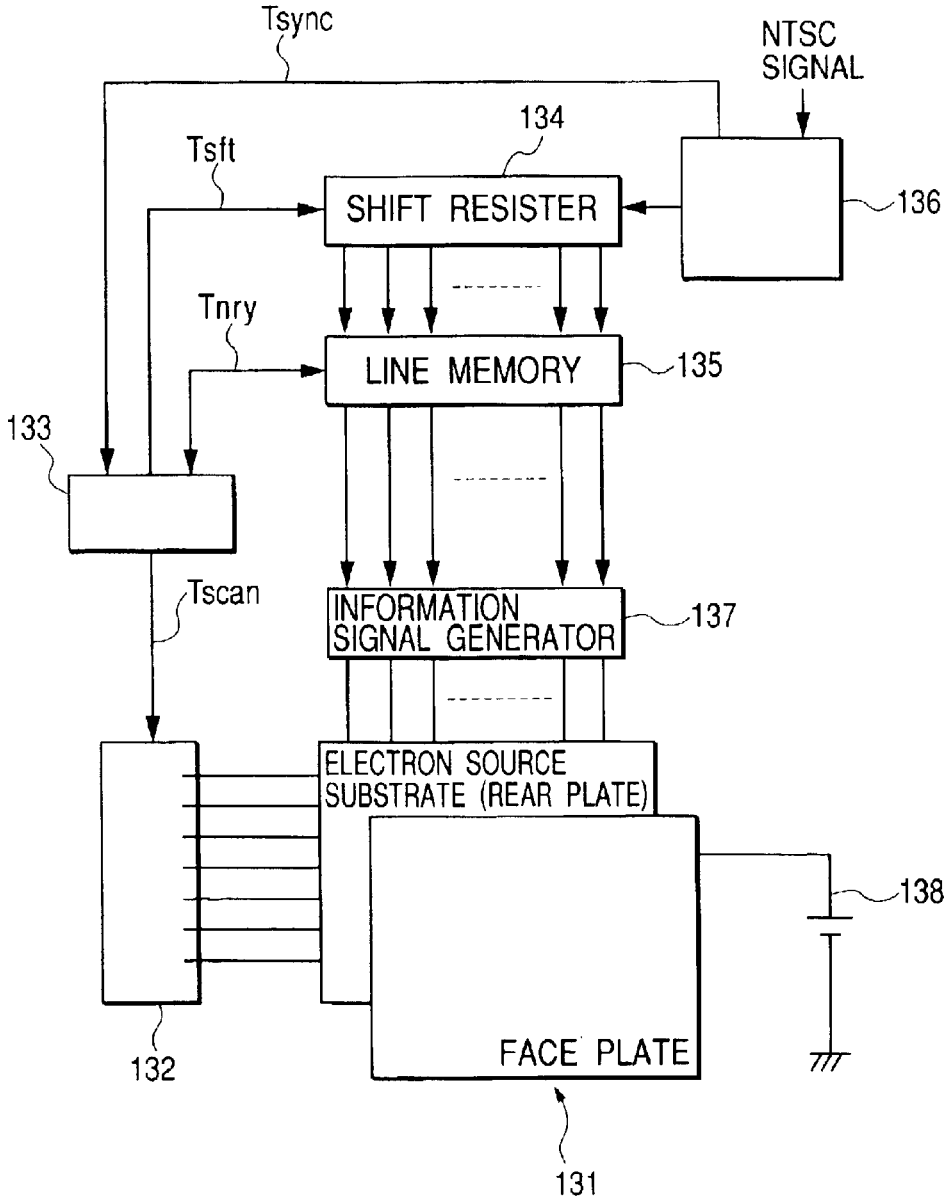
FIG. 18 is a block diagram showing a schematic configuration of an image display apparatus for TV display based on NTSC system TV signals, which is an embodiment of the display apparatus provided with the electron source substrate of the present invention.
Figure 19A:
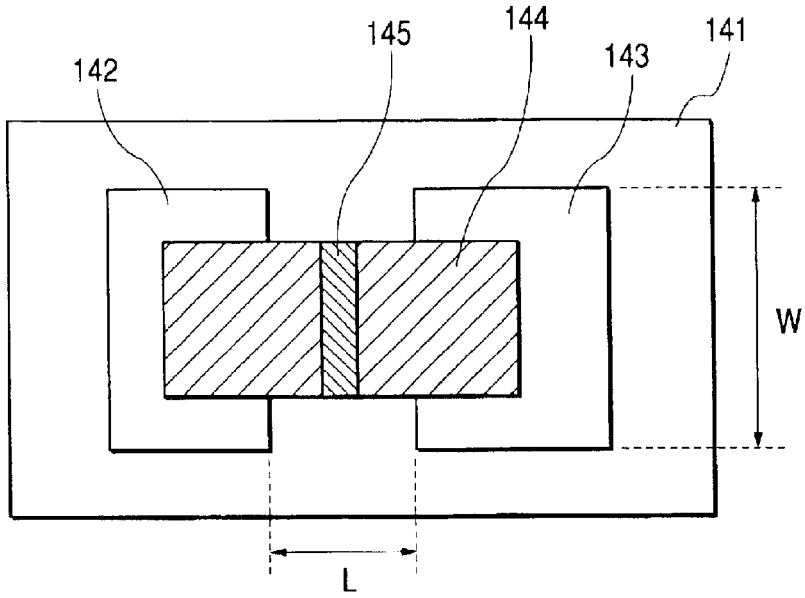
Figure 19B:
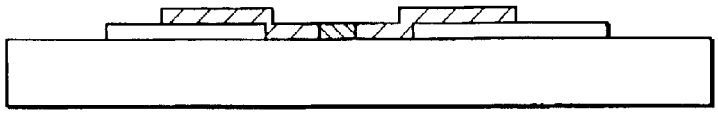
Figure 20:
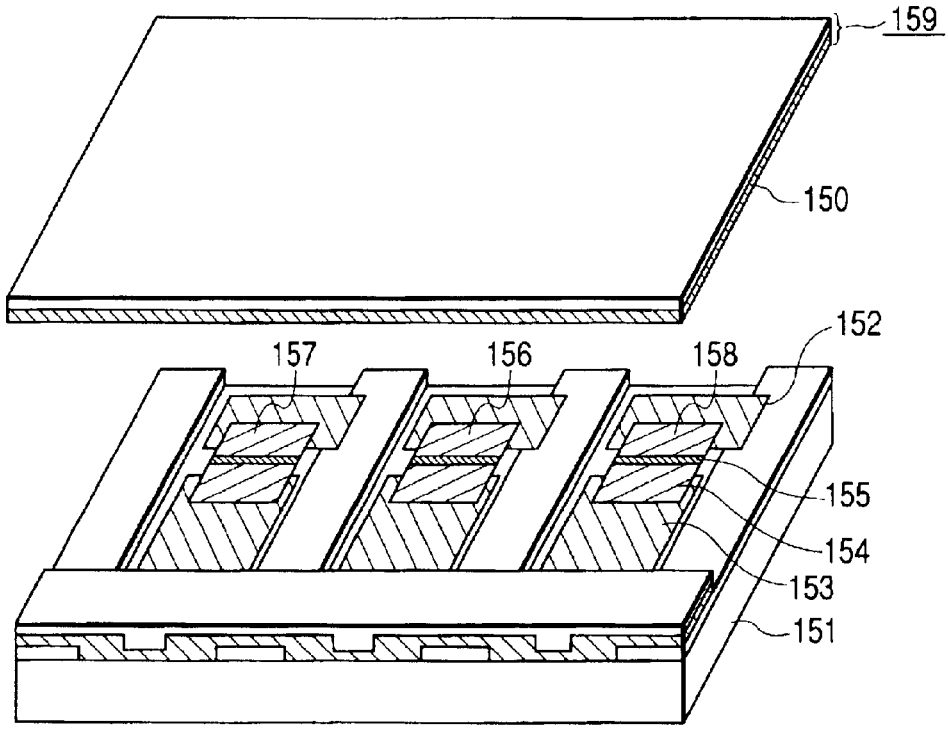
FIG. 20 is a perspective view showing a portion of a conventional display panel extracted.

FIG. 18 is a block diagram showing a schematic configuration of the image display device for television display based on NTSC system TV signals, which is an embodiment of the display apparatus provided with the electron source substrate of the present invention.

In FIG. 18, numeral 131 designates a display panel constructed using the electron source of passive matrix arrangement, 132 a scanning circuit, 133 a control circuit, 134 a shift register, 135 a line memory, 136 a sync. signal separation circuit, 137 an information signal generator, and 138 a dc high voltage supply.

The scanning circuit 132 provided with a scanning driver for applying scanning line signals is coupled to the row-directional wiring of the display panel 131 using the electron-emitting devices, and the information signal generator 137 of a data driver for applying information signals is coupled to the column-directional wiring. For carrying out the voltage modulation method, the information signal generator 137 is configured as a circuit for generating voltage pulses of a constant length and properly modulating peak heights of pulses according to input data. For carrying out the pulse width modulation method, the information signal generator 137 is configured as a circuit for generating voltage pulses with a constant peak height and properly modulating widths of the voltage pulses according to input data. In either case, in consideration of the voltage drop due to the resistor elements, the generator outputs voltages 1.1 to 1.2 times higher than desired voltages to be applied to the electron-emitting devices.

The control circuit 133 outputs each of control signals Tscan, Tsft, and Tmry to each section, based on a sync. signal Tsync sent from the sync. signal separation circuit 136. The sync. signal separation circuit 136 is a circuit for separating a sync. signal component and a luminance signal component out of the NTSC system TV signals supplied from the outside. This luminance signal component is fed into the shift register 134 in synchronism with the sync. signal.

The operation of the shift register 134 is controlled based on the shift clock sent from the control circuit 133 and it converts the luminance signal serially fed in time series, by serial-parallel conversion per line of an image. The shift register 134 outputs data of one line of the image obtained by the serial-parallel conversion (equivalent to drive data of n electron-emitting devices), in the form of n parallel signals.

The line memory 135 is a storage device for storing the data of one line of the image for a required time and feeding the stored contents to the information signal generator 137. The information signal generator 137 is a signal source for appropriately driving each of the electron-emitting devices according to the respective luminance signals, and output signals therefrom are fed through the column-directional wiring into the display panel 131 to be applied to the respective electron-emitting devices located at the intersections with the scanning line under selection by the row-directional wiring. By successively scanning the row-directional wiring lines, the electron-emitting devices can be driven across the entire panel surface.

In the display apparatus constructed as described above, the voltage is applied through the wiring electrodes in the display panel to each electron-emitting device to effect emission of electrons therefrom, and a high voltage is applied through a high voltage terminal Hv to the metal back 115 as an anode to accelerate the electron beam thus generated, toward the fluorescent film 114 to make the beam impinge thereon, thereby enabling display of an image.

During driving of this display apparatus, discharge occurred, but a drop of luminance was approximately 3% from the luminance before occurrence of the discharge. Thus there seemed no irregularity in the display screen. On the other hand, the display apparatus described previously as the conventional examples, had electron sources demonstrating the drop of luminance over 50% along the column electrodes and showed irregularities of vertical stripes passing the portions where discharge occurred.

As described above, the resistor elements coupled in series to the both ends of the surface conduction electron-emitting device present the effect of preventing the abnormal current occurring during discharge from being applied to the electron-emitting device. When the resistance of the first resistor element is set greater than the resistance of the second resistor element, the damage is reduced to the electron-emitting device and the discharge current is positively made to flow through the row-directional wiring, thereby reducing the negative effect on the drive circuits. As a result, it becomes feasible to prevent the degradation of the electron emission characteristics of the electron-emitting device or the breakage thereof, and to greatly extend the practical lifetime of the multi-electron beam source.

The configuration of the display apparatus described herein is just an example of the present invention, and a variety of modifications can be made within the scope not departing from the technical concept of the present invention. The input signals were of the NTSC system as an example, but the input signals do not have to be limited to those of this system; for example, they may be PAL, HDTV, or other signals.

EXAMPLE 2

In the present example, the resistor elements are formed only on the column-directional wiring side and the device electrodes also serve as the resistor elements. Specifically, the present example is different from aforementioned Example 1 in that the device electrodes are constructed of resistors, and the other structure is substantially the same as in Example 1. Therefore, only the part of the device electrodes will be described below in detail.

In the present example, in order to provide the device electrode coupled to the column-directional wiring with a desired resistance, the device electrode is made using a film of mixed materials of a metal and an insulator (which will be referred to hereinafter as a cermet film).

The metal used in the cermet film in the present example is platinum (Pt) and the insulator is silicon oxide ($SiO_2$). The two materials are processed each into powder, they are mixed each in desired percent by weight, and a sputtering target is fabricated by the hot press method. (Such materials are available from MITSUBISHI MATERIALS CORP.)

The reason why platinum (Pt) is used as the metal herein is that the resistance of the film can remain unchanged even through thermal history in the subsequent panel fabrication steps.

For achieving the external resistance of 1 kΩ to 2 kΩ in the thickness of 50 nm, the weight percent of the cermet film is determined so that the sheet resistance falls in the range of 100 $\Omega/cm^2$ to 200 $\Omega/cm^2$. The weight percent of platinum is determined in the range of 80 wt % to 90 wt % and the weight percent of silicon oxide in the range of 10 wt % to 20 wt %. In the present example, the weight percent of platinum was 83 wt %, and the weight percent of silicon oxide 17 wt %.

Since the device electrode coupled to the column-directional wiring was provided with the desired resistance as described above, the present example successfully prevented the discharge current upon discharge from flowing into the column-directional wiring and thus avoided the over current flowing through the column-directional wiring with the small current carrying capacity, as Example 1.

EXAMPLE 3

In the present example, an additional resistor element and a specific break line are formed between the column-directional wiring and each device electrode in the configuration of Example 2 described above, and the electron source substrate is constructed in a configuration wherein, with occurrence of large-scale discharge, the specific break line is broken to shut off flow of the discharge current into the other devices more securely. The present example will be described below with FIG. 21.

Figure 21:
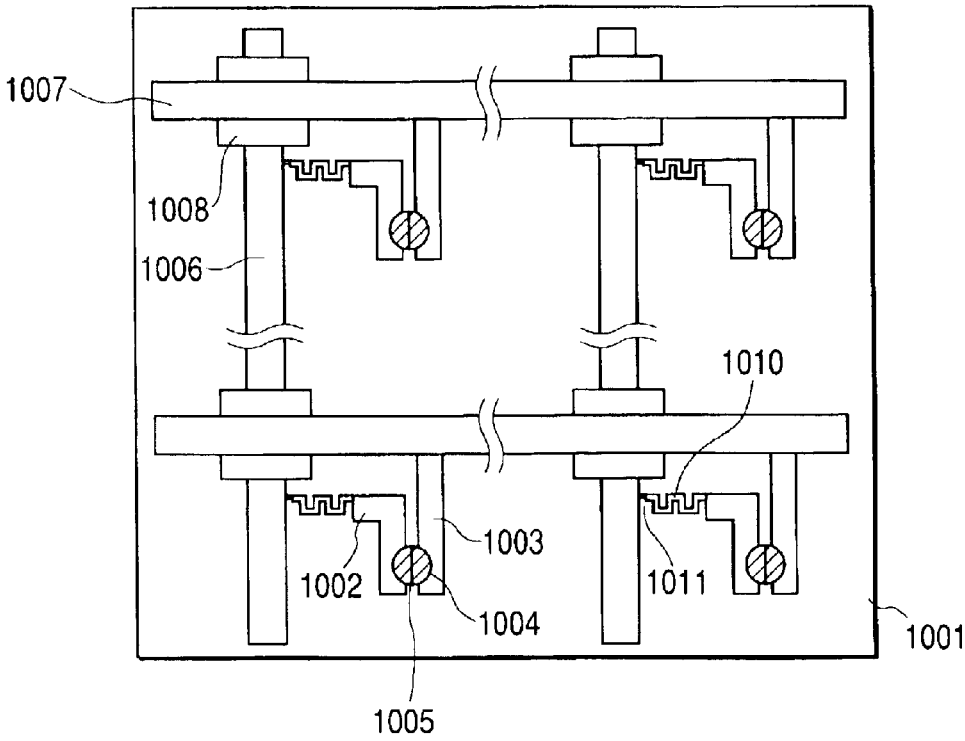
FIG. 21 is a schematic configuration diagram (plan view) showing an example of the electron source substrate according to the present invention.

FIG. 21 is a schematic configuration diagram (plan view) showing an example of the electron source substrate according to the present invention, which shows only part of the electron source substrate. In FIG. 21, numeral 1001 designates a substrate, 1002 and 1003 device electrodes, 1004 an electroconductive thin film in each device, 1005 an electron-emitting region in each device, 1006 and 1007 column-directional wiring and row-directional wiring coupled to the device electrodes 1002, 1003, respectively, 1008 interlayer dielectric layers for electrically insulating the column-directional wiring 1006 from the row-directional wiring 1007.

An external resistor 1010 is provided between the column-directional wiring 1006 and each device electrode 1002 coupled thereto. This external resistor 1010 is made of the same material as the device electrodes.

Furthermore, a specific break line 1011 is provided as part of the external resistor between the column-directional wiring 1006 and the external resistor 1010, and is also made of the same material as the device electrodes.

The material of the opposed device electrodes 1002 is preferably one with stable electrical conductivity even after the subsequent thermal treatment steps, as in Example 1, and in the present example it was the cermet film made of the mixture of platinum (Pt) and silicon oxide. In the present example the contents of platinum (Pt) and silicon oxide in the cermet film were as follows: the weight percent of platinum was 83 wt % and the weight percent of silicon oxide 17 wt %.

The external resistors 1010 were made of the same material as the device electrodes 1002, and the shape thereof was the snake shape at the ratio of distance 15 (225 μm) to pattern width 1 (15 μm) between the column-directional wiring 1006 and each device electrode 1002, so as to obtain the external resistor of 1.7 kΩ.

Furthermore, the specific break line 1011 of the width (10 μm) smaller than the pattern width (15 μm) was provided between the column-directional wiring 1006 and each external resistor 1010, as shown in FIG. 21, and the location thereof was determined at a position where it did not contact the interlayer dielectric layer 1008.

Since the basic configuration of the electron source substrate except for the above-described portions, and the other production steps are substantially the same as in Example 1, the description thereof is omitted in the present example.

In the configuration of the present example, when the high voltage is applied to the face plate, discharge can occur at a certain probability from the face plate to the electron-emitting devices on the rear plate. On this occasion, an over current is generated by the discharge, but the external resistor 1010 provided between the column-directional wiring 1006 and each device electrode 1002 can limit the current flowing into the column-directional wiring, so as to suppress breakage of the column-directional wiring with the small (supply) current carrying capacity and drive IC coupled to the column-directional wiring.

In the present example, the specific break line 1011 with the smaller pattern width is further provided between the column-directional wiring 1006 and each external resistor 1010 and, with occurrence of discharge, breakage of the external resistor due to the over current will occur at the specific break line 1011 with the smaller width, so as to cause only breakage of the specific part. In addition, the breakage of the external resistor due to the over current does not induce insulation failure between the column-directional wiring and the row-directional wiring, because it is located at the position apart from the interlayer dielectric layer 1008.

Namely, breakage of a device due to discharge does not result in secondary breakage, so that the resulting defect can be minimized. Therefore, the quality of the image display apparatus can be maintained well.

As described above, the present invention provides the effect of capability of providing the electron source with long lifetime and the display screen with high quality, because even if discharge occurs between the anode and an electron-emitting device it does not negatively affect the other electron-emitting devices.

What is claimed is:

1. An electron source substrate comprising:

a plurality of row-directional wirings laid in a row direction;

a plurality of column-directional wirings, each respectively having a wiring resistance higher than that of a row-directional wiring corresponding thereto, and laid in a column direction so as to intersect with that row-directional wiring; and a plurality of electron-emitting devices, wherein one end of each of the electron-emitting devices is electrically coupled to a corresponding row-directional wiring, a further end of each of the electron-emitting devices is electrically coupled to a corresponding column-directional wiring, and a predetermined drive voltage is supplied through said row-directional wirings and column-directional wirings to each of the electron-emitting devices, wherein electrical coupling between the further end of each of the electron-emitting devices and the corresponding column-directional wiring is formed through a first resistor element, and a resistance value of the first resistor element is larger than the wiring resistance of the column directional wirings.

2. An electron source substrate according to claim 1, wherein each of said plurality of row-directional wirings is electrically coupled to one end of a corresponding one of the plurality of electron-emitting devices through a second resistor element.

3. The electron source substrate according to claim 2, wherein the condition of $A/B \leqq C/D$ is satisfied, where A is a resistance of the first resistor element, B is a resistance of the second resistor element, C is wiring resistance of the column-directional wiring, and D is wiring resistance of the row-directional wiring.

4. The electron source substrate according to claim 1, wherein the resistor element is made of a cermet material.

5. The electron source substrate according to claim 1, wherein each electron-emitting device is a surface conduction electron-emitting device.

6. A display apparatus comprising:

a rear plate comprised of the electron source substrate as set forth in claim 1, and a face plate placed opposite said rear plate and having a fluorescent film exposed to electrons emitted from said electron source substrate.

7. An electron source substrate comprising:

a plurality of row-directional wirings laid in a row direction;

a plurality of column-directional wirings, each respectively having a wiring resistance higher than that of a row-directional wiring corresponding thereto, and laid in a column direction so as to intersect with that row-directional wiring;

a drive circuit connected to at least one end of each column-directional wiring; and a plurality of electron-emitting devices, wherein one end of each of the electron-emitting devices is electrically coupled to a corresponding one of said row- directional wirings, a further end of each of the electron-emitting devices is electrically coupled to a corresponding one of said column-directional wirings, and a predetermined drive voltage is supplied from said drive circuit to said plurality of electron-emitting devices, wherein electrical coupling between the further end of each of the electron-emitting devices and corresponding column-directional wirings is formed through a first resistor element, and a resistance value of a path between the further ends of first and second ones of said electron-emitting devices adjacent to each other and sandwiching a particular one of the column-directional wirings, is larger than a resistance value of a path between the further end of at least one of the first and second electron-emitting devices and said drive circuit.

* * * * *

UNITED STATES PATENT AND TRADEMARK OFFICE

CERTIFICATE OF CORRECTION

PATENT NO. : 7,097,530 B2
APPLICATION NO. : 10/234148
DATED : August 29, 2006
INVENTOR(S) : Kazunori Katakura et al.

It is certified that error appears in the above-identified patent and that said Letters Patent is hereby corrected as shown below:

ON TITLE PAGE AT (56) FOREIGN PATENT DOCUMENTS

Line 1,

"JP 02-247936 10/1990" should be deleted;
"JP 02-247937 10/1990" should be deleted; and
"JP 07-32683 12/1995" should read --JP 07-326283 12/1995--.

COLUMN 5

Line 25, "the" (second occurrence) should read --a--.

COLUMN 7

Line 28, "embodiment," should read --embodiment--; and
Line 63, "element" should read --element 15'--.

COLUMN 22

Line 32, "row- directional" should read --row-directional--.

Signed and Sealed this

Fifth Day of February, 2008

JON W. DUDAS
*Director of the United States Patent and Trademark Office*